US010745769B2

(12) United States Patent
Steele

(10) Patent No.: US 10,745,769 B2
(45) **Date of Patent: *Aug. 18, 2020**

(54) METHOD FOR TREATING A SUBSTRATE MADE OF ANIMAL FIBERS WITH SOLID PARTICLES AND A CHEMICAL FORMULATION

(71) Applicant: Xeros Limited, Rotherham, South Yorkshire (GB)

(72) Inventor: John Edward Steele, Rotherham (GB)

(73) Assignee: Xeros Limited, Rotherham, South Yorkshire (GB)

( * ) Notice: Subject to any disclaimer, the term of this patent is extended or adjusted under 35 U.S.C. 154(b) by 1099 days.

This patent is subject to a terminal disclaimer.

(21) Appl. No.: 14/782,729

(22) PCT Filed: Apr. 11, 2014

(86) PCT No.: PCT/GB2014/051149

§ 371 (c)(1),
(2) Date: Oct. 6, 2015

(87) PCT Pub. No.: WO2014/167359

PCT Pub. Date: Oct. 16, 2014

(65) Prior Publication Data

US 2016/0040260 A1 Feb. 11, 2016

(30) Foreign Application Priority Data

Apr. 11, 2013 (GB) ..... 1306607.1

(51) Int. Cl.
*C14C 3/22* (2006.01)
*C14C 3/06* (2006.01)
(Continued)

(52) U.S. Cl.
CPC ..... *C14C 3/22* (2013.01); *C14C 1/00* (2013.01); *C14C 1/06* (2013.01); *C14C 1/08* (2013.01);
(Continued)

(58) Field of Classification Search
CPC ..... C14C 3/22; C14C 3/06
See application file for complete search history.

(56) References Cited

U.S. PATENT DOCUMENTS 3,591,326 A 7/1971 Johnels
3,806,412 A 4/1974 Gagne et al.
(Continued)

FOREIGN PATENT DOCUMENTS

AU 702280 2/1999
CA 868968 A 4/1971
(Continued)

OTHER PUBLICATIONS

Silicon Carbide MSDS (Year: 2019).*
(Continued)

*Primary Examiner* — Vasudevan S Jagannathan
*Assistant Examiner* — Preeti Kumar
(74) *Attorney, Agent, or Firm* — Clark & Elbing LLP

(57) ABSTRACT

The invention discloses a method for treating an animal substrate comprising: agitating the moistened animal substrate with a treatment formulation and a solid particulate material in a sealed apparatus wherein the treatment formulation comprises a tanning agent or a tannery process agent. The method can comprise applying the tanning agent or tannery process agent to the animal substrate wherein at least some of the agent so applied originates from the treatment formulation. There is also disclosed an animal substrate obtained by the method. The treatment formulation can be aqueous.

55 Claims, 5 Drawing Sheets

(51) Int. Cl.

| | |
|---|---|
| ***C14C 3/28*** | (2006.01) |
| ***D06P 3/32*** | (2006.01) |
| ***D06P 7/00*** | (2006.01) |
| ***D06P 1/00*** | (2006.01) |
| ***D06P 1/96*** | (2006.01) |
| ***D06P 3/14*** | (2006.01) |
| ***C14C 3/18*** | (2006.01) |
| ***C14C 1/00*** | (2006.01) |
| ***C14C 1/06*** | (2006.01) |
| ***C14C 1/08*** | (2006.01) |
| ***C14C 3/10*** | (2006.01) |

(52) U.S. Cl.

CPC ..... *C14C 3/06* (2013.01); *C14C 3/10* (2013.01); *C14C 3/18* (2013.01); *C14C 3/28* (2013.01); *D06P 1/0032* (2013.01); *D06P 1/96* (2013.01); *D06P 3/14* (2013.01); *D06P 3/32* (2013.01); *D06P 3/326* (2013.01); *D06P 7/00* (2013.01)

(56) References Cited

U.S. PATENT DOCUMENTS

| | | | | |
|---|---|---|---|---|
| 4,221,564 | A | 9/1980 | Plapper et al. | |
| 4,272,242 | A | 6/1981 | Plapper et al. | |
| 5,709,714 | A * | 1/1998 | Natoli | C08F 265/04 8/94.21 |
| 6,237,373 | B1 | 5/2001 | Harris et al. | |
| 8,118,942 | B2 | 2/2012 | Featherson et al. | |
| 8,959,961 | B2 | 2/2015 | Jenkins et al. | |
| 8,974,545 | B2 | 3/2015 | Burkinshaw et al. | |
| 9,017,423 | B2 | 4/2015 | Burkinshaw et al. | |
| 9,121,000 | B2 | 9/2015 | Burkinshaw et al. | |
| 9,127,882 | B2 | 9/2015 | Jenkins et al. | |
| 9,297,107 | B2 | 3/2016 | Jenkins | |
| 9,315,766 | B2 | 4/2016 | He et al. | |
| 9,404,210 | B2 | 8/2016 | He et al. | |
| 9,410,278 | B2 | 8/2016 | He et al. | |
| 9,476,155 | B2 | 10/2016 | He et al. | |
| 9,487,898 | B2 | 11/2016 | He et al. | |
| 9,523,169 | B2 | 12/2016 | Sawford et al. | |
| 9,550,966 | B2 | 1/2017 | Burkinshaw et al. | |
| 9,587,337 | B2 | 3/2017 | He et al. | |
| 9,587,340 | B2 | 3/2017 | Jenkins et al. | |
| 9,631,314 | B2 | 4/2017 | Yin et al. | |
| 9,803,307 | B2 | 10/2017 | Jenkins et al. | |
| 9,834,881 | B2 | 12/2017 | Sawford et al. | |
| 9,845,516 | B2 * | 12/2017 | Steele | C14C 3/06 |
| 9,850,455 | B2 | 12/2017 | Jenkins et al. | |
| 9,850,619 | B2 | 12/2017 | Wells et al. | |
| 9,914,901 | B2 | 3/2018 | Burkinshaw et al. | |
| 9,932,700 | B2 | 4/2018 | Wells et al. | |
| 10,017,895 | B2 | 7/2018 | Wells et al. | |
| 10,081,900 | B2 | 9/2018 | Wells et al. | |
| 10,287,642 | B2 | 5/2019 | Scott | |
| 10,301,691 | B2 | 5/2019 | Feyisa et al. | |
| 10,316,448 | B2 | 6/2019 | He et al. | |
| 10,494,590 | B2 | 12/2019 | Abercrombie et al. | |
| 2004/0045092 | A1 | 3/2004 | Cassingham | |
| 2005/0229354 | A1 | 10/2005 | Dinteman et al. | |
| 2006/0101584 | A1 | 5/2006 | Hueffer et al. | |
| 2008/0011126 | A1 | 1/2008 | Duarte et al. | |
| 2008/0111269 | A1 * | 5/2008 | Politi | A61J 3/10 264/109 |
| 2008/0251356 | A1 | 10/2008 | Bratusa et al. | |
| 2009/0205142 | A1 | 8/2009 | Vorländer et al. | |
| 2011/0296628 | A1 | 12/2011 | Jenkins et al. | |
| 2012/0048299 | A1 | 3/2012 | Jenkins et al. | |
| 2012/0284931 | A1 | 11/2012 | Jenkins et al. | |
| 2012/0304400 | A1 | 12/2012 | Jenkins et al. | |
| 2013/0061404 | A1 | 3/2013 | Jenkins | |
| 2013/0167882 | A1 | 7/2013 | Burkinshaw et al. | |
| 2013/0276242 | A1 | 10/2013 | Jenkins et al. | |
| 2013/0283542 | A1 | 10/2013 | Jenkins et al. | |
| 2013/0340487 | A1 | 12/2013 | Yin et al. | |
| 2014/0123399 | A1 | 5/2014 | Reiners et al. | |
| 2014/0123402 | A1 | 5/2014 | He et al. | |
| 2014/0189961 | A1 | 7/2014 | He et al. | |
| 2014/0201929 | A1 | 7/2014 | He et al. | |
| 2014/0317860 | A1 | 10/2014 | He et al. | |
| 2015/0027173 | A1 | 1/2015 | Wu et al. | |
| 2015/0096128 | A1 | 4/2015 | Sawford et al. | |
| 2015/0096129 | A1 | 4/2015 | Sawford et al. | |
| 2015/0128358 | A1 | 5/2015 | Wells et al. | |
| 2015/0148278 | A1 | 5/2015 | Burkinshaw et al. | |
| 2015/0152357 | A1 | 6/2015 | Abercrombie et al. | |
| 2015/0152585 | A1 | 6/2015 | Sawford et al. | |
| 2015/0175945 | A1 | 6/2015 | Waddon et al. | |
| 2015/0252511 | A1 | 9/2015 | Roberts et al. | |
| 2015/0344824 | A1 | 12/2015 | Burkinshaw et al. | |
| 2016/0032522 | A1 | 2/2016 | Steele | |
| 2016/0122932 | A1 | 5/2016 | Wells et al. | |
| 2016/0122936 | A1 | 5/2016 | Wells et al. | |
| 2016/0195409 | A1 | 7/2016 | Goldberg et al. | |
| 2016/0197998 | A1 | 7/2016 | Carleo | |
| 2016/0251602 | A1 | 9/2016 | Steele et al. | |
| 2016/0251603 | A1 | 9/2016 | Steele et al. | |
| 2016/0251795 | A1 | 9/2016 | Wells et al. | |
| 2017/0051447 | A1 | 2/2017 | He et al. | |
| 2017/0137983 | A1 | 5/2017 | He et al. | |
| 2017/0159222 | A1 | 6/2017 | Jenkins et al. | |
| 2017/0240980 | A1 | 8/2017 | Feyisa et al. | |
| 2017/0240981 | A1 | 8/2017 | Scott | |
| 2017/0240982 | A1 | 8/2017 | Sadeghi | |
| 2017/0241061 | A1 | 8/2017 | Wells et al. | |
| 2017/0247771 | A1 | 8/2017 | Scott | |
| 2017/0267949 | A1 | 9/2017 | Bird et al. | |
| 2018/0057777 | A1 | 3/2018 | Waddon et al. | |
| 2018/0127914 | A1 | 5/2018 | Wells et al. | |
| 2018/0134994 | A1 | 5/2018 | Steele et al. | |
| 2018/0141089 | A1 | 5/2018 | Sawford et al. | |
| 2018/0216049 | A1 | 8/2018 | Bird et al. | |
| 2019/0144959 | A1 | 5/2019 | Ashfaq et al. | |
| 2019/0210892 | A1 | 7/2019 | Scott et al. | |
| 2019/0211288 | A1 | 7/2019 | Potts et al. | |
| 2019/0233760 | A1 | 8/2019 | Lavery et al. | |

FOREIGN PATENT DOCUMENTS

| | | | |
|---|---|---|---|
| CN | 2310074 | Y | 3/1999 |
| CN | 101360837 | A | 2/2009 |
| CN | 102061589 | A | 5/2011 |
| CN | 202175862 | U | 3/2012 |
| CN | 102425053 | A | 4/2012 |
| CN | 102425055 | A | 4/2012 |
| CN | 202214631 | U | 5/2012 |
| CN | 202214633 | U | 5/2012 |
| CN | 202298219 | U | 7/2012 |
| CN | 202298220 | U | 7/2012 |
| CN | 202298222 | U | 7/2012 |
| CN | 202298235 | U | 7/2012 |
| CN | 202323458 | U | 7/2012 |
| CN | 202359387 | U | 8/2012 |
| CN | 202359388 | U | 8/2012 |
| CN | 202359389 | U | 8/2012 |
| CN | 202359390 | U | 8/2012 |
| CN | 202359396 | U | 8/2012 |
| CN | 202492706 | U | 10/2012 |
| CN | 102782199 | A | 11/2012 |
| CN | 202543634 | U | 11/2012 |
| CN | 202543635 | U | 11/2012 |
| CN | 202543646 | U | 11/2012 |
| CN | 202543652 | U | 11/2012 |
| CN | 102899848 | A | 1/2013 |
| CN | 202688698 | U | 1/2013 |
| CN | 202755220 | U | 2/2013 |
| CN | 202755221 | U | 2/2013 |
| CN | 102953249 | A | 3/2013 |
| CN | 102953250 | A | 3/2013 |
| CN | 102953262 | A | 3/2013 |
| CN | 102978870 | A | 3/2013 |
| CN | 103061084 | A | 4/2013 |

(56) References Cited

FOREIGN PATENT DOCUMENTS

| | | | | |
|---|---|---|---|---|
| CN | 103061085 | A | 4/2013 | |
| CN | 103061086 | A | 4/2013 | |
| CN | 103061087 | A | 4/2013 | |
| CN | 103087839 | A | 5/2013 | |
| CN | 103103720 | A | 5/2013 | |
| CN | 103103721 | A | 5/2013 | |
| CN | 103122566 | A | 5/2013 | |
| CN | 103122567 | A | 5/2013 | |
| CN | 202913242 | U | 5/2013 | |
| CN | 202989172 | U | 6/2013 | |
| CN | 103225192 | A | 7/2013 | |
| CN | 203049283 | U | 7/2013 | |
| CN | 103361934 | A | 10/2013 | |
| CN | 103361938 | A | 10/2013 | |
| CN | 203370359 | U | 1/2014 | |
| CN | 102061588 | B | 2/2014 | |
| CN | 103556439 | A | 2/2014 | |
| CN | 203530695 | U | 4/2014 | |
| CN | 203530700 | U | 4/2014 | |
| CN | 203530714 | U | 4/2014 | |
| CN | 203530718 | U | 4/2014 | |
| CN | 203530723 | U | 4/2014 | |
| CN | 203530725 | U | 4/2014 | |
| CN | 103285643 | B | 4/2015 | |
| CN | 103451894 | B | 11/2015 | |
| CN | 103556434 | B | 11/2015 | |
| CN | 103556436 | B | 11/2015 | |
| CN | 103556431 | B | 1/2016 | |
| CN | 103556432 | B | 3/2016 | |
| CN | 105420992 | A | 3/2016 | |
| CN | 105420993 | A | 3/2016 | |
| CN | 105421000 | A | 3/2016 | |
| CN | 105442267 | A | 3/2016 | |
| CN | 205329373 | U | 6/2016 | |
| CN | 205329374 | U | 6/2016 | |
| CN | 205329380 | U | 6/2016 | |
| CN | 205329384 | U | 6/2016 | |
| EP | 0439108 | A1 | 7/1991 | |
| EP | 0306236 | B1 * | 4/1993 | ..... A61K 8/0279 |
| GB | 498506 | A | 1/1939 | |
| GB | 592707 | A | 9/1947 | |
| GB | 874232 | A | 8/1961 | |
| GB | 1186368 | A | 4/1970 | |
| GB | 1332999 | A | 10/1973 | |
| GB | 1481508 | A | 8/1977 | |
| GB | 2287953 | A | 10/1995 | |
| JP | H01318100 | A | 12/1989 | |
| JP | H09-512573 | A | 12/1997 | |
| JP | 2003017457 | A | 1/2003 | |
| JP | 2009148699 | A | 7/2009 | |
| KR | 10-0237982 | B1 | 3/2000 | |
| KR | 20-0292892 | Y1 | 10/2002 | |
| RO | 98565 | B1 | 3/1990 | |
| RU | 2206619 | C1 | 6/2003 | |
| SU | 720020 | A1 | 3/1980 | |
| WO | WO-88/10317 | A1 | 12/1988 | |
| WO | WO-0212569 | A1 * | 2/2002 | ..... C14C 3/06 |
| WO | WO-2004/061136 | A1 | 7/2004 | |
| WO | WO-2007/128962 | A1 | 11/2007 | |
| WO | WO-2009/153345 | A2 | 12/2009 | |
| WO | WO-2010/094959 | A1 | 8/2010 | |
| WO | WO-2011/064581 | A1 | 6/2011 | |
| WO | WO-2011/098815 | A1 | 8/2011 | |
| WO | WO-2011/128676 | A1 | 10/2011 | |
| WO | WO-2012/056252 | A2 | 5/2012 | |
| WO | WO-2012/095677 | A2 | 7/2012 | |
| WO | WO-2014006425 | A1 * | 1/2014 | |
| WO | WO-2014/080192 | A1 | 5/2014 | |
| WO | WO-2014/14739 | A1 | 9/2014 | |

OTHER PUBLICATIONS

U.S. Appl. No. 15/532,137, Xeros Ltd.
U.S. Appl. No. 15/414,314, He et al.
U.S. Appl. No. 15/510,569, Xeros Ltd.
U.S. Appl. No. 15/510,576, Xeros Ltd.
U.S. Appl. No. 15/513,014, Xeros Ltd.
U.S. Appl. No. 15/513,309, Xeros Ltd.
U.S. Appl. No. 15/518,047, Xeros Ltd.
Afsar et al., "An investigation about the effect of oxazolidine on modified valonia extract tanning," African Journal of Biotechnology. 7(20):3737-42 (2008).
Jing et al., "A novel oxazolidine tanning agent and its use in vegetable combination tanning," The Journal of the Society of Leather Technologists and Chemists 95(4):165-70 (2011).
Musa et al., "Studies on combination tanning based on henna and oxazolidine," The Journal of the American Leather Chemist's Association 104(10):335-43 (2009).
U.S. Appl. No. 15/344,120, He et al.
U.S. Appl. No. 14/588,500, Xeros Ltd.
U.S. Appl. No. 14/588,510, Xeros Ltd.
U.S. Appl. No. 14/777,559, Xeros Ltd.
U.S. Appl. No. 14/777,568, Xeros Ltd.
U.S. Appl. No. 14/777,573, Xeros Ltd.
U.S. Appl. No. 14/782,719, Xeros Ltd.
U.S. Appl. No. 14/902,498, Xeros Ltd.
U.S. Appl. No. 14/902,506, Xeros Ltd.
International Search Report and Written Opinion for International Patent Application No. PCT/GB2014/051149, dated Oct. 17, 2014 (11 pages).
International Search Report and Written Opinion for International Patent Application No. PCT/GB2014/051150, dated Oct. 17, 2014 (12 pages).
Search Report for United Kingdom Application No. GB1306607.1, dated Aug. 29, 2013 (5 pages).
U.S. Appl. No. 15/748,234, Bird et al.
Hudson et al, "Leather coloration," Rev. Prog. Coloration. 30: 67-75 (2000).
U.S. Appl. No. 16/093,398, Xeros Ltd.
U.S. Appl. No. 16/093,433, Xeros Ltd.
U.S. Appl. No. 16/093,449, Xeros Ltd.
U.S. Appl. No. 16/318,192, Xeros Ltd.
U.S. Appl. No. 16/481,583, Xeros Ltd.

* cited by examiner

A

B

A) Trial 2

Control: 100% Substrate: 25% water

PET beads-water: 100% Substrate: 75% beads: 25% water

B) Trial 3

Control: 100% Substrate: 0% water

PET beads-water: 100% Substrate: 100% beads: 0% water

A

B

A

B

METHOD FOR TREATING A SUBSTRATE MADE OF ANIMAL FIBERS WITH SOLID PARTICLES AND A CHEMICAL FORMULATION

This invention relates to an improved method for treating an animal substrate and particularly to methods of treating an animal substrate by tanning and/or by one or more associated tannery processes.

BACKGROUND

Current methods for treating or processing animal substrates such as skins, hides, pelts, and leather can necessitate the use of vast quantities of water. For example, in treatment methods wherein the animal substrate comprises a hide, typically 30 kg of water is required per kg of hide. Large volumes of water can be needed in order to remove unwanted materials from the animal substrate (such as those that are liable to decomposition) and in subsequent steps of the process which involve chemical modification to confer certain properties on the animal substrate. Chemical modification of the substrate can be carried out for the purpose of, inter alia, preserving, waterproofing, colouring and/or providing any desired textural or aesthetic qualities. The various steps described above will generally be performed in the presence of a treatment formulation comprising one or more components.

Due to the large quantity of water relative to the weight of animal substrate, current treatment processes known in the art require a commensurate increase in the amount of chemicals used in the treatment formulation to ensure an effective treatment of the substrate within an acceptable timeframe. Consequently, excessive amounts of polluting and environmentally damaging effluents are produced from such processes. Furthermore, because only low levels of mechanical action can be used to avoid damaging the animal substrate, long process times are necessary.

Many of the methods for preparing animal substrates for human use still remain predominantly based on traditional processes and there have been few advances in recent years. For example, methods for the processing and manufacturing of leather have remained largely unchanged for 75 years. EP0439108 filed in 1991 and directed to a process using carbon dioxide for deliming of hides, discloses an example of one of the few recent developments in this field.

Prior to the development of the method disclosed herein, the inventors have previously addressed the problem of reducing water consumption in a domestic or industrial cleaning method. Thus, in WO-A-2007/128962 there is disclosed a method and formulation for cleaning a soiled substrate, the method comprising the treatment of the moistened substrate with a formulation comprising a multiplicity of polymeric particles, wherein the formulation is free of organic solvents. However, although the process disclosed therein relates to an improved means for cleaning a soiled substrate requiring less water, the application does not disclose a method or process for treating an animal substrate.

There is therefore needed an improved method for treating or preparing an animal substrate by tanning and/or by one or more associated tannery processes which ameliorates or overcomes the above-noted problems associated with the methods of the prior art. Particularly, there is needed such a method for treating an animal substrate which requires less water than the methods of the prior art and that reduces the volume of polluting and hazardous effluent produced from such a method. Furthermore, there is a desired such a method for treating an animal substrate which is faster, more efficient and provides a substrate with improved properties when compared with methods of the prior art. Still further there is a need for such a method of treating an animal substrate which provides a substrate with one or more of the following properties:

i. Deeper penetration of components of the treatment formulation into the animal substrate;

ii. More uniform treatment of the surface of the animal substrate;

iii. Improved fixation of the treatment formulation components into the animal substrate;

iv. Improved surface aesthetics including feel and appearance;

v. Improved resistance of the treated animal substrate to shrinkage;

vi. Reduced creasing and/or mechanical damage to the animal substrate;

vii. Improved longevity of the final treated substrate.

BRIEF SUMMARY OF THE DISCLOSURE

According to a first aspect of the present invention there is provided a method for treating an animal substrate comprising: agitating the moistened animal substrate with a treatment formulation and a solid particulate material in a sealed apparatus, wherein the treatment formulation comprises at least one treatment agent selected from tanning agents, re-tanning agents and tannery process agents.

In some preferred embodiments the treatment formulation can be aqueous.

In some variations of these embodiments, the treatment formulation can comprise water and no organic solvent.

In other preferred embodiments the treatment formulation can be waterless. In these embodiments, preferably the treatment formulation is waterless in the sense that the treatment formulation contains no added water other than that introduced from the moistened animal substrate. Thus, water can be carried into the treatment formulation with the moistened hide.

In some preferred embodiments the tanning agent and/or tannery processing agents can be selected to chemically modify the animal substrate, such as, for example, by linking and locking collagen protein strands of the animal substrate together. In some embodiments the three dimensional protein structure of the animal substrate can be modified.

In some preferred embodiments the at least one treatment agent can be a tanning agent.

In some preferred embodiments the tannery process agent can comprise a chemical used in the treatment of an animal substrate in one or more tannery processes, said process being selected from one or more of cleaning, curing, beamhouse treatments including soaking, liming, unhairing, scudding, fleshing, deliming, bating, pickling and fat liquoring, enzyme treatment, and dye fixing.

In some preferred embodiments the tannery process agent can comprise a chemical used in the treatment of an animal substrate in one or more tannery processes, said process being selected from one or more of cleaning, curing, liming, deliming, enzyme treatment, and dye fixing.

In some preferred embodiments soaking and/or deliming processes can be carried out at a pH which is typically basic, preferably greater than pH 7, less than pH 14, more preferably greater than pH 9, less than pH 13.

In some preferred embodiments the tanning or retanning agent can be selected from synthetic tanning agents, vegetable tanning or retanning agents and mineral tanning agents such as chromium III salts.

In some preferred embodiments the Chromium III salt can be present in an amount of 6% w/w or less based on the mass of the animal substrate, and preferably 5% w/w or less, more preferably 4.5% w/w or less.

In some preferred embodiments the animal substrate can be hide, pelt or skin.

In some preferred embodiments the animal substrate can be leather.

In some preferred embodiments the sealed apparatus can comprises a treatment chamber in the form of a rotatably mounted drum or a rotatably mounted cylindrical cage and the method can comprise agitating said animal substrate and said treatment formulation by rotating said treatment chamber.

In some preferred embodiments the method can comprise applying the tanning agent or tanning process agent to the animal substrate wherein at least some of the tanning agent or tanning process agent so applied originates from the treatment formulation. More preferably substantially all of the tanning agent or tanning process agent so applied originates from the treatment formulation.

In some preferred embodiments the method can comprise, before or after said agitating the moistened animal substrate with a treatment formulation and a solid particulate material, subjecting said animal substrate to at least one further treatment comprising contacting the animal substrate with at least one colourant.

In some preferred embodiments said further treatment can comprise: agitating the moistened animal substrate with an aqueous colourant treatment formulation and a solid particulate material in a sealed apparatus, the aqueous colourant treatment formulation comprising at least one colourant.

In some preferred embodiments said further treatment can comprise applying the colourant to the animal substrate wherein at least some of the colourant so applied originates from the colourant treatment formulation.

In some preferred embodiments substantially all of the colourant so applied originates from the treatment formulation.

In some preferred embodiments the aqueous colourant treatment formulation in said further treatment can have a pH less than 7.

In some preferred embodiments the further treatment can comprise a dye penetration stage and a subsequent dye fixing stage, in which the treatment formulation for said further treatment comprises at least one dye, and wherein said treatment formulation has a pH less than 7 in the dye penetration stage and a pH less than 7 in the dye fixing stage.

In some preferred embodiments the further treatment can comprise a dye penetration stage and a subsequent dye fixing stage, in which the treatment formulation for said further treatment comprises at least one dye, and wherein said treatment formulation has a pH less than 7 in the dye penetration stage and a pH greater than 7 in the dye fixing stage.

In some preferred embodiments the colourant can be selected from one or more dyes, pigments, optical brighteners or mixtures thereof.

In some preferred embodiments the colourant can be one or more dyes selected from anionic, cationic, acidic, basic, amphoteric, reactive, direct, chrome-mordant, pre-metallised, sulphur dyes.

In some preferred embodiments the method can comprise an additional step of cleaning the animal substrate. In some embodiments, the method can comprise cleaning the animal substrate before agitating the moistened animal substrate with the treatment formulation and a solid particulate material in a sealed apparatus in the presence of the one or more tanning agents, re-tanning agents or tannery process agents.

In some preferred embodiments the ratio of solid particulate material to animal substrate can be from 1000:1 to 1:1000 w/w such as from about 5:1 to about 1:5 w/w and in particular from about 1:2 to about 1:1 w/w.

In some preferred embodiments where the treatment formulation is aqueous, the ratio of water to solid particulate material in the treatment formulation can be from 1000:1 to 1:1000 w/w such as from about 1:1 to about 1:100 w/w.

In some preferred embodiments the substrate can be moistened by wetting so as to achieve a water to animal substrate ratio of between 1000:1 and 1:1000 w/w such as from about 1:100 to about 1:1 w/w In some preferred embodiments where the treatment formulation is aqueous the ratio of water to animal substrate in the treatment formulation can be from at least 1:40 w/w to about 10:1 w/w.

In some preferred embodiments where the treatment formulation is aqueous the treatment formulation can comprise at least 5% w/w water.

In some preferred embodiments where the treatment formulation is aqueous the treatment formulation can comprise not more than 99.9% w/w water.

In some preferred embodiments where the treatment formulation is aqueous the ratio of the solid particulate material to the animal substrate to water can be from about 1:1:1 to about 50:50:1 w/w such as from 4:3:1 to 2:1:1, in particular 4:3:1 or 2:1:1.

In some preferred embodiments where the treatment formulation is waterless the ratio of the solid particulate material to the animal substrate to water is from about 1:1:0 to about 50:50:0 w/w such as from 4:3:0 to 2:1:0, in particular 4:3:0 or 2:1:0.

In some preferred embodiments wherein the solid particulate material can have an average density of 0.5 to 20 $g/cm^3$ such as in particular 0.5 to 3.5 $g/cm^3$. In some embodiments polymeric particles having a density of 0.5 to 3.5 $g/cm^3$ are particularly suitable.

In some preferred embodiments the solid particulate material can have an average mass of 1 mg to 5 kg. In some embodiments, the solid particulate material can have an average mass of 1 mg to 500 g, in other embodiments 1 mg to 100 g and in further embodiments the polymeric or non-polymeric particles have an average mass of 5 mg to 100 mg.

In some preferred embodiments the solid particulate material can have an average particle diameter of from 0.1 to 500 mm and in particular from 1 mm to 500 mm. In some embodiments the solid particulate material can have an average particle diameter of from 0.5 to 50 mm or 0.5 to 25 mm or 0.5 to 15 mm or 0.5 to 10 mm or 0.5 to 6.0 mm, in other embodiments of from 1.0 to 5.0 mm and in further embodiments of from 2.5 to 4.5 mm. The effective average diameter can also be calculated from the average volume of a particle by simply assuming the particle is a sphere. The average is preferably a number average. The average is preferably performed on at least 10, more preferably at least 100 particles and especially at least 1000 particles.

In some preferred embodiments the solid particulate material can have a length of from 0.1 to 500 mm and in particular from 1 mm to 500 mm. In some embodiments the solid particulate material can have a length of from 0.5 to 50 mm or 0.5 to 25 mm, or from 0.5 to 15 mm or from 0.5 to 10 mm, or from 0.5 to 6.0 mm, in other embodiments of from 1.0 to 5.0 mm and in further embodiments of from 2.5 to 4.5 mm. The length can be defined as the maximum 2 dimensional length of each 3 dimensional polymeric or non-polymeric particle. The average is preferably a number average. The average is preferably performed on at least 10, more preferably at least 100 particles and especially at least 1000 particles.

In some preferred embodiments the solid particulate material can comprise a multiplicity of polymeric particles, a multiplicity of non-polymeric particles or a mixture of a multiplicity of polymeric and non-polymeric particles.

In some preferred embodiments the polymeric or non-polymeric particles can comprise or be in the form of beads.

In some preferred embodiments the polymeric particles can have an average volume of from 5 to 275 $mm^3$.

In some preferred embodiments the polymeric particles can comprise particles of polyalkenes, polyamides, polyesters, polysiloxanes, polyurethanes or copolymers thereof.

In some embodiments, the polymeric particles can comprise particles of polyalkenes or polyurethanes, or copolymers thereof.

In some embodiments, the polymeric particles can comprise particles of polyamide or polyester or copolymers thereof.

In some embodiments, said polyamide particles can comprise particles of nylon.

In some embodiments, the polyamide particles can comprise Nylon 6 or Nylon 6,6.

In some embodiments, the polyester particles can comprise particles of polyethylene terephthalate or polybutylene terephthalate. In an embodiment, the polymeric particles comprise linear, branched or cross-linked polymers.

In some embodiments, the polymeric particles can comprise foamed or unfoamed polymers.

In some embodiments, the polymeric or non-polymeric particles can be solid, hollow or porous.

In some embodiments, the polymeric or non-polymeric particles can be partially or substantially dissolvable.

In some embodiments, the polymeric or non-polymeric particles can be chemically modified to include one or more moieties selected from the group consisting of: enzymes, oxidizing agents, catalysts, metals, reducing agents, chemical cross-linking agents and biocides.

In some preferred embodiments the non-polymeric particles can comprise particles of ceramic material, refractory material, igneous, sedimentary or metamorphic minerals, composites, metal, glass or wood.

In some preferred embodiments of the method according the invention the treatment formulation can comprises one or more components selected from the group consisting of: solvents, surfactants, cross-linking agents, metal complexes, corrosion inhibitors, complexing agents, biocides, builders, catalysts, chelating agents, dispersants, perfumes, optical brightening agents, enzymes, dyes, pigments, oils, waxes, waterproofing agents, flame retardants, stain repellants, reducing agents, acids, bases, neutralizing agents, polymers, resins, oxidising agents and bleaches.

In some preferred embodiments the treatment formulation can comprises two or more portions and each portion of the treatment formulation can be the same or different.

In some preferred embodiments the treatment formulation can comprises at least a first portion for cleaning the animal substrate and at least a second portion comprising said at least one treatment agent selected from tanning agents, re-tanning agents and tannery process agents.

In some preferred embodiments each portion of the treatment formulation can be added at different time points during the treatment of the animal substrate.

In some preferred embodiments the treatment formulation can comprise at least one surfactant.

In some embodiments, said surfactants can be selected from non-ionic and/or anionic and/or cationic surfactants and/or ampholytic and/or zwitterionic and/or semi-polar nonionic surfactants.

In some embodiments, said at least one surfactant can be a non-ionic surfactant.

In some embodiments, the treatment formulation can comprise at least one colourant.

In some embodiments, the treatment formulation can comprise a first portion comprising enzymes and a second portion substantially free from enzymes.

In some preferred embodiments the method can include a step of exposing the animal substrate to carbon dioxide.

In some preferred embodiments the method can include a step of exposing the animal substrate to ozone.

In some embodiments the treatment formulation can comprise one or more optical brightening agents which can usefully be selected from the group consisting of: stilbene derivatives, benzoxazoles, benzimidazoles, 1,3-diphenyl-2-pyrazolines, coumarins, 1,3,5-triazin-2-yls and naphthalimides.

In an embodiment, said enzymes are selected from hemicellulases, peroxidases, proteases, carbonic anhydrases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, [beta]-glucanases, arabinosidases, hyaluronidase, chondroitinase, laccase, amylases and mixtures thereof.

In some embodiments, said oxidizing agents or bleaches can be selected from peroxygen compounds.

In some embodiments, said peroxygen compounds can be selected from the group consisting of: hydrogen peroxide, inorganic peroxy salts and organic peroxy acids.

In some preferred embodiments the particles can be re-used at least once in a subsequent treatment process according to the method. In some preferred embodiments the particles can be re-used at least two, three, four, five or more times, such as 10, 20, 50 or 100 or more times, in a subsequent treatment process according to the method. The particles are typically not reused more than 10,000 or more than 1,000 times. When the polymeric or non-polymeric particles are reused it is often desirable to intermittently clean the particles. This can be helpful in preventing unwanted contaminants from building up and/or in preventing treatment components from degrading and then depositing on the animal substrate. The particle cleaning step can be performed after every 10, after every 5, after every 3, after every 2 or after every 1 agitation step(s). The particle cleaning step can comprise washing the polymeric or non-polymeric particles with a cleaning formulation. The cleaning formulation can be a liquid medium such as water, an organic solvent or a mixture thereof. Preferably, the cleaning formulation can comprise at least 10 wt %, more preferably at least 30 wt %, even more preferably at least 50 wt %, especially at least 80 wt % water, more especially at least 90 wt % water. The cleaning formulation can comprise one or more cleaning agents to aid the removal of any contaminants. Suitable cleaning agents can include surfactants, detergents, dye transfer agents, biocides, fungicides, builders and metal chelating agents. The particles can be cleaned at a temperature of from 0 to 40° C. for energy economy but for even better cleaning performance temperatures of from 41 to 100° C. can be used. The cleaning times can generally be from 1 second to 10 hours, typically from 10 seconds to 1 hour and more typically from 30 seconds to 30 minutes. The cleaning formulation can be acidic, neutral or basic depending on the pH which best provides for cleaning of the specific treatment formulation components. During cleaning it can be desirable that the polymeric or non-polymeric particles are agitated so as to speed up the cleaning process. Preferably, the cleaning step can be performed in the absence of any animal substrate. Preferably the method can be performed in an apparatus fitted with an electronic controller unit which is programmed to perform the agitation step (cycle) and then intermittently the particle cleaning step (cycle). When a different treatment formulation is used and/or a different substrate it can be desirable to perform the particle cleaning step so as to prevent or reduce the potential for any cross contamination of chemicals or materials.

Thus, in some preferred embodiments the method of the invention can include the step of subjecting the particles to a cleaning procedure after the treatment of the animal substrate.

In some preferred embodiments the method can comprise recirculating the solid particulate material into the treatment chamber via recirculation means or apparatus.

In some preferred embodiments uncoated, washed or cleaned solid particulate material can be introduced into the treatment chamber.

In some preferred embodiments said uncoated, washed or cleaned solid particulate material can be introduced in the presence of said animal substrate.

In some preferred embodiments the solid particulate material can be recovered from the treatment chamber after the treatment of the animal substrate.

In some preferred embodiments the solid particulate material does not penetrate the surface of the animal substrate.

In some preferred embodiments of the method according to the invention, the method can consist of a treatment cycle comprising one or more phases or stages.

In some preferred embodiments the treatment formulation can comprise at least a first portion and a second portion, said first portion being added at a different phase or stage in the treatment cycle to the second portion of the treatment formulation.

In some preferred embodiments the method can be performed over a period of from 1 minute to 100 hours.

In some preferred embodiments each phase or stage in the treatment cycle can be performed over a period of from 1 minute to 100 hours. In some embodiments, each phase or stage in the treatment cycle can be performed over a period of from 1 minute to 100 hours or 30 seconds to 10 hours.

In some preferred embodiments at least one phase or stage of the method can be carried out at a temperature of between 0° C. and 100° C.

In some preferred embodiments at least one phase or stage of the method can be carried out at a temperature of from 20 to 60° C.

In some preferred embodiments at least one phase or stage of the method can be carried out under pressure.

In some preferred embodiments at least one phase or stage of the method can be carried out under vacuum.

In some preferred embodiments at least one phase or stage of the method can be carried out under cooling.

In some preferred embodiments at least one phase or stage of the method can be carried out under heating.

In some preferred embodiments the method can comprise adding a first portion of the treatment formulation and agitating the moistened animal substrate with the treatment formulation in the sealed apparatus before introducing the solid particulate material.

In some preferred embodiments the method can comprise agitating the moistened animal substrate with the solid particulate material in the sealed apparatus before adding the treatment formulation.

In some preferred embodiments the method can comprise the steps of:

a) agitating the moistened animal substrate with a first portion of the treatment formulation and a solid particulate material in a sealed apparatus;

b) removing the solid particulate material;

c) adding a second portion of the treatment formulation and agitating the moistened animal substrate with the treatment formulation.

In some preferred embodiments the sealed apparatus can comprise one or more dosing compartments suitable for containing one or more portions of the treatment formulation.

In some preferred embodiments, the method comprises no step configured to coat the solid particulate material with the tanning agent or tannery process agent prior to contact of the particulate material with the animal substrate.

In some preferred embodiments the treatment chamber can comprise perforations.

In some embodiments, the method can comprise a step comprising milling the animal substrate.

In some embodiments, the method can comprise a step conditioning the animal substrate.

In some embodiments, the method can comprise a step drying the animal substrate.

In some preferred embodiments the method of this first aspect can comprise preparing an animal substrate for human use.

In some preferred embodiments the method can comprise one or more subsequent processing steps selected from drying, coating, lacquering, polishing, cutting, shaping, forming, embossing, punching, gluing, sewing, stapling and packaging the treated animal substrate or one or more parts thereof.

In some preferred embodiments the said one or more subsequent processing steps can comprise producing a finished leather substrate. A finished leather substrate can be a whole hide or a portion or part thereof.

A finished leather substrate as defined herein is a leather substrate to which no further processing step need be applied for changing its colour, physical or chemical structure or finish to render the leather suitable for producing a finished leather good. For the avoidance of doubt a finished leather substrate can be subject to subsequent processing steps including one or more of polishing, cutting, shaping, forming, embossing, punching, gluing, sewing, stapling and packaging for producing a finished leather good.

In some preferred embodiments the said one or more subsequent processing steps can comprise producing a finished leather good. The finished leather good can preferably be a leather good suitable for use by industries or manufactories other than, or suitable for distribution or sale through trade or retail channels subsequent to, the leather manufacturing (e.g. tanning and/or dyeing) industry. In embodiments of the invention a finished leather good can be produced from a finished leather substrate by one or more processing steps selected from drying, coating, lacquering, polishing, cutting, shaping, forming, embossing, punching, gluing, sewing, stapling and packaging of the finished leather substrate. The finished leather could can be made or wholly or in part from leather, in particular from a finished leather substrate.

Said finished leather good can be selected from one or more of: articles of apparel and personal accessories, footwear, bags, briefcases, satchels and suitcases, saddlery, furniture and upholstered articles, sporting goods and accessories, pet collars and leashes, and vehicle interior coverings.

Where said finished leather good is footwear, the finished leather good can be selected from one or more of shoes, boots, sports shoes, trainers, pumps, sneakers, sandals and the like.

Where said finished leather good is an article of apparel, the finished leather good can be selected from one or more of gloves, jackets, coats, hats, trousers, neckties, belts, straps, protective clothing (such as motorcycle leathers), and the like. Where said finished leather good is a personal accessory, the finished leather good can be selected from one or more of purses, wallets, spectacle cases, card cases, watchstraps, wristbands, protective covers for portable electronic devices, leather-bound books such as diaries and notebooks, and the like.

Where said finished leather good is an upholstered article, the finished leather good can be selected from one or more articles of furniture such as chairs and seats, tuffets, pouffes and hassocks, ottomans, stools, tables, desks (e.g. tables or desks having a leather covering), sofas, couches, divans, banquettes and bed heads. Where said finished leather good is a seat, the finished leather good can be a seat for a vehicle, such as a car seat or a train, bus, coach or aircraft seat.

Where said finished leather good is a vehicle interior covering, the finished leather good can be a covering for a fascia, dashboard, console, door capping or the like. The method of the invention can include shaping a finished leather substrate by forming, cutting or the like and applying the finished leather substrate to a supporting part of said vehicle interior.

Where said finished leather good is an article of saddlery, the finished leather good can be a saddle, harness, bridle, whip or the like or other tack, in particular for equine use.

According to a second aspect of the present invention there is provided an animal substrate obtained by the method of the above first aspect of the invention. The inventors believe that the mechanical action resulting from the agitation of the solid particulate with the animal substrate and the treatment formulation can yield an animal substrate with different or improved properties compared to those produced by methods of the prior art.

According to a third aspect of the present invention there is provided a finished leather good or a component of a finished leather good obtained by a method according the first aspect of the invention or comprising an animal substrate according the second aspect of the invention.

In some embodiments of this third aspect, the finished leather good can be as defined above in relation to the first aspect.

In the context of the present application, the term "method for treating an animal substrate" can refer to modifying or transforming the properties of a substrate immediately derived from an animal, in particular before the animal substrate is treated or processed to form a manufactured article. Notably, the method of the invention is distinguished from processes such as "laundering" wherein the substrate is typically a garment or fabric (being a manufactured article) and the properties of the substrate are not transformed after the process has been performed.

Advantageously, the method of the invention facilitates the use of only limited amounts of water thereby offering significant environmental benefits compared to standard processes commonly employed in this field. In fact, the method of the invention can typically provide a water usage saving of at least 75% compared with the best water usage saving that can be achieved by the methods of the prior art. As the quantity of water used in the method of the invention is significantly reduced, the amount of chemicals required in the treatment formulation in order to provide an effective treatment of the animal substrate is decreased. Furthermore, a more uniform and enhanced or effective mechanical action on the substrate resulting from the agitation with the solid particulate material can reduce the duration of the necessary treatment cycle providing improvements in efficiency over processes of the prior art.

BRIEF DESCRIPTION OF THE DRAWINGS

Embodiments of the invention are further described hereinafter with reference to the accompanying drawings, in which.

DETAILED DESCRIPTION

Figure 1:
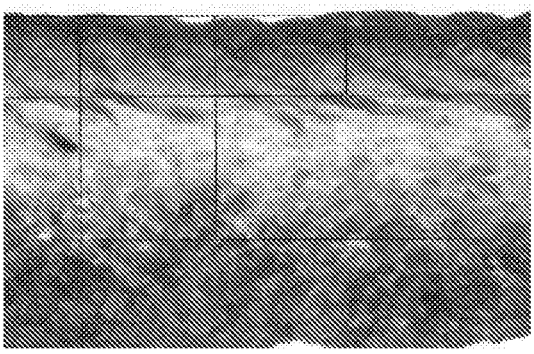
FIG. 1 is an image from an optical microscope showing samples tanned with Tara extract after 30 minutes comparing (A) control sample with 50%: 50% substrate: water and (B) PET beads-water sample with Substrate:Beads:water 100%: 50%: 50%.
Figure 1:
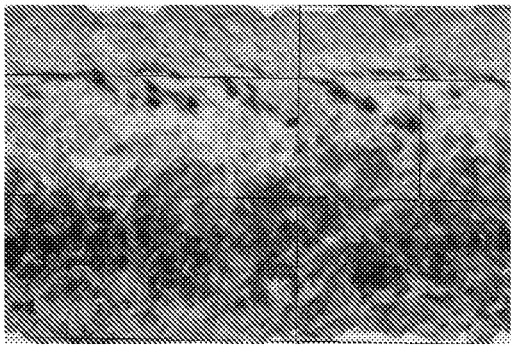

The method of the invention comprises agitating a moistened animal substrate with an treatment formulation and a solid particulate material in a sealed apparatus. The method of the invention relates to a treatment process for modifying or transforming the properties of a substrate immediately derived from an animal. Thus in some embodiments, the animal substrate may require one or more treatments before it is suitable for human use. Such treatments may thus be required before the animal substrate can be used for consumer, domestic and/or industrial purposes (for example, in clothing, upholstery or automotive industries).

The treatment method of the invention can comprise a cleaning step. In certain embodiments, the cleaning step can be performed prior to a chemical modification of the substrate. Cleaning may be necessary to remove any unwanted materials adhered to the exterior of the animal substrate. In some embodiments, a treatment formulation to be used in the cleaning step can comprise one or more enzymes. In certain embodiments, the treatment formulation can comprise proteolysis enzymes. In order to enhance cleaning of the animal substrate, in particular in a cleaning step, the treatment formulation can comprise one or more surfactants. In some preferred embodiments, the treatment formulation can comprise non-ionic surfactants.

The treatment method of the invention can comprise one or more additional steps to remove further unwanted materials from the animal substrate. For example, the animal substrate can be subject to liming and deliming. In such embodiments, the treatment formulation, at least for such additional steps, can comprise reducing agents, bases, acids and/or neutralizing agents.

In other embodiments the animal substrate may be modified in order to modify the scale structure or impart shrink resist properties. In a particular embodiment, the treatment formulation may include oxidizing agents (such as peroxymonosulphuric acid), chlorine, enzymes, or reducing agents (such as sodium metabisulphite to prevent loop distortion).

The solid particulate material can comprise a multiplicity of polymeric or non-polymeric particles. Most preferably, the solid particulate material can comprise a multiplicity of polymeric particles. Alternatively, the solid particulate material can comprise a mixture of polymeric particles and non-polymeric particles. In other embodiments, the solid particulate material can comprise a multiplicity of non-polymeric particles. Thus the solid particulate material in embodiments of the invention can comprise exclusively polymeric particles, exclusively non-polymeric particles or mixtures of polymeric and non-polymeric particles in any desired relative amounts. Throughout this disclosure wherever a ratio is quoted with respect to polymeric and/or non-polymeric particles this will be understood as a reference to the sum total of polymeric and/or non-polymeric particles that may constitute the solid particulate material.

The polymeric or non-polymeric particles are of such a shape and size as to allow for good flowability and intimate contact with the animal substrate. A variety of shapes of particles can be used, such as cylindrical, spherical ellipsoidal, spheroidal or cuboid; appropriate cross-sectional shapes can be employed including, for example, annular ring, dog-bone and circular. The particles can have smooth or irregular surface structures and can be of solid, porous or hollow construction. Non-polymeric particles comprising naturally occurring materials such as stone may have various shapes, dependent on their propensity to cleave in a variety of different ways during manufacture. Most preferably, however, said particles can comprise cylindrical, ellipsoidal, spheroidal or spherical beads.

The polymeric or non-polymeric particles are preferably of such a size as to have an average mass in the region of 1 mg to 5 kg, preferably in the region of 1 mg to 500 g, more preferably from 1 mg to 100 g and most preferably 5 mg to 100 mg. In the case of the most preferred particles, typically referred to as beads, the preferred average particle diameter can be in the region of from 0.1 or 1 to 500 mm, 0.5 or 1 to 25 mm or 50 mm, 0.5 or 1 to 15 mm, 0.5 or 1 to 10 mm or preferably from 0.5 to 6.0 mm, more preferably from 1.0 to 5.0 mm, most preferably from 2.5 to 4.5 mm, and the length of the beads can be preferably in the range from 0.1 or 1 to 500 mm, more preferably from 0.5 or 1 to 25 mm or 50 mm, or from 0.5 or 1 to 15 mm or from 0.5 or 1 to 10 mm, even more preferably from 0.5 to 6.0 mm, more preferably from 1.5 to 4.5 mm, and is most preferably in the region of from 2.0 to 3.0 mm.

In some embodiments, the polymeric or non-polymeric particles can be partially or substantially dissolvable.

The polymeric or non-polymeric particles can be chemically modified to include additional moieties. Thus in some embodiments the particles can be chemically modified to further include one or more moieties selected from the group consisting of: enzymes, oxidizing agents, catalysts, metals, reducing agents, chemical cross-linking agents and biocides.

The polymeric particles can comprise polyalkenes such as polyethylene and polypropylene, polyamides, polyesters, polysiloxanes or polyurethanes. Furthermore, said polymers can be linear, branched or crosslinked. In certain embodiments, said polymeric particles can comprise polyamide or polyester particles, particularly particles of nylon, polyethylene terephthalate or polybutylene terephthalate, typically in the form of beads. Copolymers of the above-polymeric materials can also be employed for the purposes of the invention. The properties of the polymeric materials can be tailored to specific requirements by the inclusion of monomeric units which confer particular properties on the copolymer. Various nylon homo- or co-polymers can be used including, but not limited to, Nylon 6 and Nylon 6,6. In an embodiment, the nylon comprises Nylon 6,6 copolymer, preferably having a molecular weight in the region of from 5000 to 30000 Daltons, more preferably from 10000 to 20000 Daltons, most preferably from 15000 to 16000 Daltons. The polyester can typically have a molecular weight corresponding to an intrinsic viscosity measurement in the range of from 0.3 to 1.5 dl/g, as measured by a solution technique such as ASTM D-4603. In certain embodiments, said polymeric particles can comprise synthetic or natural rubber.

The polymeric or non-polymeric particles can be solid, porous or hollow. Furthermore, the polymeric or non-polymeric particles may be filled or unfilled. Where the polymeric or non-polymeric particles are filled, said particles can comprise, for example, additional moieties within the particle interior.

In some embodiments, the polymeric particles can have an average density of 0.5 to 3.5 g/cm$^3$ and an average volume of 5 to 275 mm$^3$.

In certain embodiments, the solid particulate material comprises non-polymeric particles. In such embodiments, the non-polymeric particles can comprise particles of ceramic material, refractory material, igneous, sedimentary or metamorphic minerals, composites, metal, glass or wood. Suitable metals include, but are not limited to, zinc, titanium, chromium, manganese, iron, cobalt, nickel, copper, tungsten, aluminium, tin and lead, and alloys thereof (such as steel). Suitable ceramics can include, but are not limited to, alumina, zirconia, tungsten carbide, silicon carbide and silicon nitride.

In some embodiments, the non-polymeric particles may have an average density of 0.5 to 20 g/cm$^3$, more preferably from 2 to 20 g/cm$^3$ and especially from 4 to 15 g/cm$^3$.

In order to provide lubrication for the treatment system, the animal substrate is moistened. This can be achieved by wetting the substrate with water and, most conveniently, the substrate can be wetted simply by contact with mains or tap water. The wetting of the substrate can be carried out so as to achieve a water to animal substrate ratio of between 1000:1 and 1:1000 w/w. Typically, the ratio of water to animal substrate can be from 1:100 to 1:1 w/w more typically from 1:50 to 1:2 w/w, especially typically from 1:40 to 1:2 w/w, more especially typically from 1:20 to 1:3 w/w and most typically from 1:15 to 1:5 w/w. In some embodiments, the ratio of water to animal substrate is at least 1:40 w/w, at least 1:30 w/w, at least 1:20 w/w or at least 1:15 w/w. In some embodiments, the ratio of water to animal substrate is no more than 10:1 w/w, no more than 5:1 w/w, no more than 2:1 w/w or no more than 1:1 w/w.

The treatment formulation of the invention can comprise one or more components effective to modify the animal substrate in some way and optionally impart certain properties to the modified substrate. Thus the treatment formulation can contain ingredients which perform a cleaning function and ingredients that elicit other effects such as chemical modification of the substrate. The treatment formulation of the invention can comprise one or more components selected from the group consisting of: solvents, surfactants, cross-linking agents, metal complexes, corrosion inhibitors, complexing agents, biocides, builders, catalysts, chelating agents, dispersants, perfumes, optical brightening agents, enzymes, dyes, pigments, oils, waxes, waterproofing agents, flame retardants, stain repellants, reducing agents, acids, bases, neutralizing agents, polymers, resins, oxidising agents and bleaches.

Surfactants can be selected from non-ionic and/or anionic and/or cationic surfactants and/or ampholytic and/or zwitterionic and/or semi-polar nonionic surfactants.

In some embodiments suitable builders can be included in the treatment formulation and these include, but are not limited to, the alkali metal, ammonium and alkanolammonium salts of polyphosphates, alkali metal silicates, alkaline earth and alkali metal carbonates, aluminosilicates, polycarboxylate compounds, ether hydroxypolycarboxylates, copolymers of maleic anhydride with ethylene or vinyl methyl ether, 1,3,5-trihydroxybenzene-2,4,6-trisulphonic acid, and carboxymethyl-oxysuccinic acid, various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid and soluble salts thereof.

Optionally, the treatment formulation can also contain dispersants. Suitable water-soluble organic materials are the homo- or co-polymeric acids or their salts, in which the polycarboxylic acid may comprise at least two carboxyl radicals separated from each other by not more than two carbon atoms.

Optionally, the treatment formulation can also contain perfumes. Suitable perfumes can generally be multi-component organic chemical formulations which can contain alcohols, ketones, aldehydes, esters, ethers and nitrile alkenes, and mixtures thereof. Commercially available compounds offering sufficient substantivity to provide residual fragrance include Galaxolide (1,3,4,6,7,8-hexahydro-4,6,6,7,8,8-hexamethylcyclopenta(g)-2-benzopyran), Lyral (3- and 4-(4-hydroxy-4-methyl-pentyl)cyclohexene-1-carboxaldehyde and Ambroxan ((3aR,5aS,9aS,9bR)-3a,6,6,9a-tetramethyl-2,4,5,5a,7,8,9,9b-octahydro-1H-benzo[e][1]benzofuran). One example of a commercially available fully formulated perfume is Amour Japonais supplied by Symrise® AG.

In some embodiments, the animal substrate can include an optical brightening agent. Suitable optical brighteners which can be included in the treatment formulation fall into several organic chemical classes, of which the most popular are stilbene derivatives, whilst other suitable classes include benzoxazoles, benzimidazoles, 1,3-diphenyl-2-pyrazolines, coumarins, 1,3,5-triazin-2-yls and naphthalimides. Examples of such compounds can include, but are not limited to, 4,4'-bis[[6-anilino-4(methylamino)-1,3,5-triazin-2-yl]amino]stilbene-2,2'-disulphonic acid, 4,4'-bis[[6-anilino-4-[(2-hydroxyethyl)methylamino]-1,3,5-triazin-2-yl]amino]stilbene-2,2'-disulphonic acid, disodium salt, 4,4'-Bis[[2-anilino-4-[bis(2-hydroxyethyl)amino]-1,3,5-triazin-6-yl]amino]stilbene-2,2'-disulphonic acid, disodium salt, 4,4'-bis[(4,6-dianilino-1,3,5-triazin-2-yl)amino]stilbene-2,2'-disulphonic acid, disodium salt, 7-diethylamino-4-methylcoumarin, 4,4'-Bis[(2-anilino-4-morpholino-1,3,5-triazin-6-yl)amino]-2,2'-stilbenedisulphonic acid, disodium salt, and 2,5-bis(benzoxazol-2-yl)thiophene.

The method of the invention can comprise a step wherein the animal substrate is agitated with a treatment formulation comprising one or more oils. The inclusion of one or more oils in the treatment formulation can impart specific properties to the substrate. In some embodiments, the treatment formulation can comprise oils with at least one sulphur moiety such as sulphated and/or sulphited oils to provide softness and flexibility to the animal substrate. In other embodiments, oils can be included to provide anti-static control, reduce friction and/or to improve lubrication.

Suitable acids which can be contained in the treatment formulation include, but are not limited to, sulphuric acid, formic acid and ammonium salts. Suitable bases can include, but are not limited to, calcium hydroxide and sodium hydroxide. Suitable neutralizing agents include, but are not limited to, sodium carbonate and sodium bicarbonate.

Enzymes that can be used in the treatment formulation can include, but are not limited to, hemicellulases, peroxidases, proteases, carbonic anhydrases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, [beta]-glucanases, arabinosidases, hyaluronidase, chondroitinase, laccase, amylases and mixtures thereof.

Dyes that may be used in the treatment formulation can include, but are not limited to, anionic, cationic, acidic, basic, amphoteric, reactive, direct, chrome-mordant, premetallised and sulphur dyes.

In some embodiments of the invention, the treatment formulation can include one or more bleaches and/or oxidizing agents. Examples of such bleaches and/or oxidizing agents can include, but are not limited to, ozone, peroxygen compounds, including hydrogen peroxide, inorganic peroxy salts, such as perborate, percarbonate, perphosphate, persilicate, and mono persulphate salts (e.g. sodium perborate tetrahydrate and sodium percarbonate), and organic peroxy acids such as peracetic acid, monoperoxyphthalic acid, diperoxydodecanedioic acid, N,N'-terephthaloyl-di(6-aminoperoxycaproic acid), N,N'-phthaloylaminoperoxycaproic acid and amidoperoxyacid. The bleaches and/or oxidizing agents can be activated by a chemical activation agent. Activating agents can include, but are not limited to, carboxylic acid esters such as tetraacetylethylenediamine and sodium nonanoyloxybenzene sulphonate. Alternatively, the bleach compounds and/or oxidizing agents can be activated by heating the formulation.

In some embodiments, the treatment method of the invention can include one or more chemical modification steps in order to colour the substrate. Thus in such embodiments, the treatment formulation can include at least one colourant. The colourant can be selected from, for example, one or more dyes, pigments, optical brighteners or mixtures thereof.

The solid particulate material can be substantially uncoated with one, several or all components of the treatment formulation (excluding of course water). In particular, prior to at least a first agitation step it is preferred that the solid particulate material is not coated with a colourant (e.g. a dye or a pigment). The treatment formulation and the solid particulate material can be premixed prior to the agitation step but this is preferably under conditions which do not promote or cause the colourant to coat the particles of the solid particulate material. So for example, the colourant can be a dye which is soluble in the treatment formulation, e.g. having a solubility of greater than 1 g per litre, more preferably greater than 2 g per litre and especially greater than 5 g per litre of the treatment formulation, and/or additional organic solvents can be added to the water in the treatment formulation to promote solubility of the dye, and/or the solid particulate material can be chosen which specifically has no affinity with the dye. Suitable organic solvents can include water-miscible alcohols, glycols, amides and the like. When the colourant is insoluble or only partially soluble in the treatment formulation it is preferred that the colourant is dispersed with one or more dispersants. These can be cationic, anionic or non-ionic dispersants. In one embodiment coating of the solid particulate material is prevented or inhibited by having dispersants of the same type which stabilize both the solid particulate material and the colourant during the agitation step. For example both the colourant and the solid particulate material can be dispersed with an anionic dispersant, both can be dispersed with a cationic dispersant or both can be dispersed with a non-ionic dispersant. When dispersing the colourant it is preferably a pigment, an insoluble dye or a slightly soluble dye (<1 g litre) dye. When the colourant is dispersed or dissolved in the treatment formulation in the presence of the particulate solid this is preferably done below 30° C., more preferably below 25° C. Using lower temperatures tends to reduce the possibility for coating the solid particulate material.

The colourant can be dispersed or dissolved in the treatment formulation. In some embodiments the colourant can be dispersed or dissolved in the treatment formulation in the absence of the solid particulate material. This can help to prevent any possibility that the colourant pre-coats the solid particulate material. The solid particulate material can then be added prior to or during agitation. Alternatively, the colourant can be dispersed or dissolved in an aqueous liquid medium (again in the absence of the solid particulate material) and then added to the treatment formulation.

In some preferred embodiments, a mixture of the treatment formulation containing a colourant and the solid particulate material can be such that substantially no coating of the solid particulate material results and the colourant does not penetrate into the solid particulate material. In one embodiment this can be determined by: i. adding 100 g of solid particulate material to 100 g of water containing 2 wt % of colourant; ii. stirring the mixture for 1 hour at 25° C.; iii. removing the solid particulate material from the water by means of filtration; iv. measuring the amount of colourant remaining in the water (e.g. by colourimetic, UV, refractive index or gravimetric analysis); and v. calculating the amount of colourant which has not coated or penetrated the solid particulate material. Preferably, this value should mean that greater than 90 wt %, more preferably greater than 95 wt %, especially greater than 98 wt % and more especially greater than 99 wt % of the colourant remains in the water. Preferably, the water is at pH 7.

In some embodiments the treatment formulation can comprises a colourant and the further treatment steps according to the method can comprise applying the colourant to the animal substrate wherein at least some of the colourant so applied originates from the treatment formulation. Typically, at least some, more typically essentially all of the colourant so applied was, prior to application, physically separate from the solid particulate material. Preferably, at least 50 wt %, more preferably at least 70 wt %, especially at least 90 wt %, more especially at least 99 wt % and most especially essentially all the colourant which is applied to the animal substrate originates from the treatment formulation (and not from the surface or interior of the solid particulate material). Preferably, during the method which comprising applying a colourant to the animal substrate there is no measurable net loss of colourant from the solid particulate material. This shows that essentially all of the colour applied to the animal substrate originates from the treatment formulation. Typically, the amount of colourant in or coating the particulate solid will remain constant or may just slightly rise during the agitation process.

The treatment formulation can have a basic (>7), an acidic (<7) or neutral (7) pH. In many embodiments can be desirable that the pH of the treatment formulation in certain treatment steps or stages is acidic. The acidic pH is typically less than 6.9, more typically less than 6.5, even more typically less than 6 and most typically less than 5.5. The acidic pH is typically no less than 1, more typically no less than 2 and most typically no less than 3. The pH or the treatment formulation can differ at different times, points or stages in the treatment process according to embodiments of the invention. Preferably, the treatment formulation has the above typical pH value for at least some time during the agitation.

In some embodiments of the invention, before or after said agitating the moistened animal substrate with an aqueous or waterless treatment formulation and a solid particulate material, the methods of the present invention can include any one or more of the following steps used in the production of leather including: curing, beam house operations, fatliquoring, scudding, preserving, soaking, liming, unhairing, fleshing, splitting, reliming, bating, degreasing, frizzing, bleaching, pickling, depickling, pretanning, tanning, retanning, tawing, crusting, coating, colouring (dyeing) and finishing.

In some embodiments, the treatment formulation may include one or more tanning agents. The tanning agents can be synthetic tanning agents. Suitable synthetic tanning agents include, but are not limited to amino resins, polyacrylates, fluoro and/or silicone polymers and formaldehyde condensation polymers based on phenol, urea, melamine, naphthalene, sulphone, cresol, bisphenol A, naphthol and/or biphenyl ether.

The tanning agents can be vegetable tanning agents. Vegetable tanning agents comprise tannins which are typically polyphenols. Vegetable tanning agents can be obtained from plant leaves, roots and especially tree barks. Examples of vegetable tanning agents can include the extracts of the tree barks from chestnut, oak, redoul, tanoak, hemlock, quebracho, mangrove, wattle *acacia*; and myrobalan.

The tanning agents can be mineral tanning agents. Particularly suitable mineral tanning agents comprise chromium compounds, especially chromium salts and complexes. The chromium is preferably in a chromium (III) oxidation state. A preferred chromium (III) tanning agent is chromium (III) sulphate.

Other tanning agents can include aldehydes (glyoxal, glutaraldehyde and formaldehyde), oxazolidine, phosphonium salts, metal compounds other than chromium (e.g. iron, titanium, zircomium and alumunium compounds). The treatment formulation, especially for tanning, can be acidic, neutral or basic. Vegetable and chromium tanning agents are preferably used with acidic treatment formulations.

The treatment formulation can preferably comprise sulfuric, hydrochloric, formic or oxalic acid in embodiments where acidic formulations are to be used.

In some embodiments the water in the treatment formulation has been softened or demineralized.

When, in a further treatment step, the method is desired to colour a hide or a skin then the further treatment can be performed during or after tanning and wherein the treatment formulation comprises a colourant. In one embodiment a hide or skin can first be tanned e.g. using chromium to provide a "wet blue" product. This tanned (e.g. wet blue) product can then be used as the substrate in the methods of the present invention wherein at least one of the components of the treatment formulation is a colourant. Performing the colouration in this way has been found to produce animal hides and skins with especially good colour shade, intensity, colour uniformity and substantivity of colouration.

In certain embodiments, the treatment formulation can include one or more waterproofing agents. Examples of suitable waterproofing agents are hydrophobic silicones. In further embodiments, the treatment formulation can include one or more flame retardants. Suitable flame retardants can include, but are not limited to, titanium hexfluoride or zirconium hexafluoride. In particular embodiments, the treatment formulation can include one or more stain repellants. Suitable stain repellants can include, but are not limited to, polysulphones, waxes, salts, silicone polymers and polytetrafluoroethylene (PTFE).

As the method of the invention can be used with significantly less water than methods of the prior art, in embodiments of the invention, the quantity of chemicals or chemical loading in the treatment formulation can be reduced.

In some embodiments treatment formulation comprises water. In embodiments wherein the solid particulate material comprises polymeric and/or non-polymeric particles, the ratio of water to polymeric and/or non-polymeric particles can be in the region of from 1000:1 to 1:1000 w/w. Preferably, the ratio of treatment formulation to polymeric and/or non-polymeric particles is from 10:1 to 1:100 w/w, more preferably from 1:1 to 1:100 w/w, even more preferably from 1:2 to 1:100 w/w, yet more preferably from 1:5 to 1:50 w/w and especially from 1:10 to 1:20 w/w. In some embodiments the ratio of treatment formulation to polymeric and/or non-polymeric particles can be from 1:1 to 1:3.

In some embodiments the ratio of polymeric and/or non-polymeric particles to substrate is from 1000:1 to 1:1000 w/w, more preferably from 10:1 to 1:10 w/w, especially from 5:1 to 1:5 w/w, more especially from 4:1 to 1:2 w/w and most especially from 1:2 to 1:1 w/w.

In some embodiments treatment formulation can comprise water alone or it can comprise water and one or more organic solvents. In certain embodiments the organic solvents are water-miscible. Preferred organic solvents can be alcohols, glycols and amides. In certain embodiments, the treatment formulation comprises at least 10 wt %, more preferably at least 50 wt %, especially at least 80 wt %, more especially at least 90 wt % and most especially at least 95 wt % of water. In some embodiments no organic solvents are present in the treatment formulation other than trace amounts from impurities in other components of the treatment formulation.

As the treatment formulation can comprise multiple components, portions of the formulation can be added at different time points during a typical treatment cycle for the method of the invention. In this context, the term "treatment cycle" refers to the total duration required to modify or transform the animal substrate and may comprise one or more phases or stages. For example, a first portion of the treatment formulation can be added to the animal substrate before the addition of the solid particulate material. Thus the animal substrate can be agitated with the treatment formulation alone in the sealed apparatus prior to agitation with the treatment formulation and the solid particulate material as a first phase of the treatment process. A second portion of the treatment formulation can be added at a different time point in the treatment cycle. In certain embodiments, the solid particulate material can be removed before adding the second portion of the treatment formulation. Following the removal of the particulate material and the addition of the second portion of the treatment formulation, a second phase of the treatment process can be commenced with further agitation of the animal substrate with the treatment formulation. The respective first and second treatment formulation portions can comprise the same or different components. Furthermore, the treatment formulation can be divided into multiple portions wherein each portion comprises the same or different components. A series of treatment phases or stages can thus be conducted over the duration of the treatment cycle wherein the treatment formulation can be kept constant or varied for each respective phase.

In some embodiments, the treatment cycle of the invention can comprise a cleaning step and a chemical modification step. In such embodiments, the treatment formulation can comprise a first portion with one or more components for cleaning the substrate and a second portion with one or more components for chemically modifying (by tanning or tannery processes) the substrate. The respective first and second portions can be added at different time points during the treatment cycle. Hence the treatment cycle can consist of cleaning phase and a chemical modification phase wherein the addition of the first portion of the treatment formulation instigates the cleaning phase and the addition of the second portion of the treatment formulation instigates the chemical modification phase. In other embodiments, the cleaning and chemical modification of the substrate can occur simultaneously.

In certain embodiments, the treatment formulation can comprise a first portion and a second portion wherein the first portion is substantially free from enzymes and a second portion comprises enzymes. In such embodiments, the first portion of the treatment formulation can be added at a first phase in the treatment cycle and the second portion of the treatment formulation can be added at a second phase in the treatment cycle.

In some embodiments, the solid particulate material can be retained throughout the treatment cycle as portions of the treatment formulation are added as outlined above. In other embodiments, the solid particulate material can be replaced prior to the addition of a further portion of the treatment formulation. This can be necessary to ensure that the animal substrate is not adversely affected by interactions occurring between incompatible chemical moieties. For example, chemical moieties which could potentially adhere to the solid particulate material following the introduction of one portion of the treatment formulation may not be compatible with chemical moieties present in a subsequent portion of the treatment formulation thus necessitating replacement of the solid particulate material before continuing the treatment cycle.

At one or more stages the treatment cycle of the invention, the animal substrate can be subjected to heating or cooling. Furthermore, the animal substrate can be placed under conditions of vacuum or pressure. Furthermore, the animal substrate can be subjected to milling, conditioning or drying.

In certain embodiments, the method of the invention can comprise exposing the animal substrate to one or more agents during the treatment cycle in addition to the treatment formulation. Exposure to said one or more agents can be performed as the moistened animal substrate is agitated with the treatment formulation or in a separate step during the treatment cycle when the treatment formulation is not present. In such embodiments, the one or more agents can be gaseous. Exposure of the animal substrate to the gaseous agents can occur by introduction of said agents into the sealed apparatus at one or points during the treatment cycle. In some embodiments the gaseous agents can be carbon dioxide and/or ozone.

The duration of the treatment cycle can be any period from 1 minute to 100 hours and in other embodiments the duration of the treatment cycle can be from 1 minute to 48 hours. In embodiments wherein the treatment cycle comprises more than one phase, each respective phase of the treatment cycle can be any period of 30 seconds or greater or 1 minute or greater wherein the sum of the respective phases comprises the total duration of the treatment cycle. In certain embodiments each respective phase of the treatment cycle can be a period of from 30 seconds to 10 hours. The method of the invention can facilitate a considerable reduction in the duration of a typical treatment cycle as the presence of the solid particulate material can enhance the effect or degree of mechanical action performed on the animal substrate. Thus the duration of each phase of the process can be reduced leading to a typical reduction of 20 to 50% of the total duration of the treatment cycle when compared to the methods employed in the prior art. In some embodiments, the mechanical action performed on the animal substrate by virtue of agitation with the solid particulate material is never sufficient to break up the animal substrate.

One or more phases of the method of the invention can be performed at a temperature of from 0 to 100° C. Furthermore, the method can include one or more heating or cooling steps. Thus the temperature may be raised or lowered between the values of 0 and 100° C. at one or more points throughout the treatment cycle. In some embodiments one or more phases of the method can be performed at a temperature of from 0 to 60° C. such as from 20 to 60° C. and in other embodiments at a temperature of from 30 to 50 or 60° C. As the method of the invention can lead to a reduction in the duration of the treatment cycle, it is possible for the method to be operated effectively at lower temperatures. For example, in one or more phases of the treatment cycle the method of the invention can effectively be performed at ambient temperature as opposed to higher temperatures which are generally required in the processes of the prior art. Also, because smaller amounts of treatment formulation can be used the amount of energy required to obtain these temperatures can be substantially reduced.

The method of the invention may comprise a batchwise or a continuous process. Alternatively, the method of the invention may comprise a combination of batchwise and continuous processes.

The method of the invention need not be conducted in the same sealed apparatus. Hence one phase or stage of the treatment can be carried out in one sealed apparatus and further phases or stages of the treatment can be carried out in different sealed apparatus. Thus the animal substrate can be transferred from one sealed apparatus to another in order to continue or complete the treatment. The method of the invention can include phases or stages where additional processing is carried out in unsealed apparatus such as certain beamhouse operations. The method of the invention can include a phase or stage where separation of polymer or non-polymer particles in carried out in additional sealed or unsealed apparatus.

In embodiments of the invention wherein the solid particulate material comprises polymeric and/or non-polymeric particles, said particles can be treated or reacted with additional compounds or materials. In some embodiments, said particles can be treated with surfactants. In certain embodiments, said particles can be treated with one or more compounds selected from the group consisting of: sodium and potassium hydroxides, hypochlorates, hypochlorites, hydrogen peroxide, inorganic peroxy salts and organic peroxy acids.

The method of the invention can be carried out in an apparatus which is sufficiently large so as to accommodate the animal substrate to be treated and the treatment formulation, whilst still providing sufficient ullage to allow for efficient circulation and mixing of the materials when agitated during the treatment process. Typically, allowance should be made for ullage values of at least 10% by volume, preferably at least 20% by volume, and most preferably from 30 to 70% or 30-60% by volume in order to provide for efficient mixing whilst maximising the utilisation capacity of the method.

The sealed apparatus for treating the animal substrate can comprise a treatment chamber and optionally one or more dosing compartments wherein each respective dosing compartment can contain at least one portion of the treatment formulation. The one or more dosing compartments can be adapted to dispense one or more portions of the treatment formulation at one or more predetermined time points in the treatment cycle.

The sealed apparatus for performing the method of the invention can be a device adapted for mechanical rotation. The sealed apparatus can include a treatment chamber which serves to contain the animal substrate and the treatment formulation during agitation. In certain embodiments, the treatment chamber comprises a rotating drum or a rotatably mounted cylindrical cage. The sealed apparatus can comprise a housing means within which the drum or cage is mounted. Typically, the drum or cage includes an aperture or means to allow for the ingress or egress of the treatment formulation whilst ensuring the animal substrate remains within the confines of the drum or cage. In certain embodiments, the drum or cage can comprise perforations. The perforations may be sufficiently sized to allow for the entry and exit of the solid particulate material.

The sealed apparatus can further comprise at least one circulation means or apparatus to enable circulation of the treatment formulation. For example, the apparatus can include ducting and a pumping device to allow for the exit and re-entry of the treatment formulation in the treatment chamber. Furthermore, the sealed apparatus can additionally comprise at least one recirculation means or apparatus to facilitate recirculation of the solid particulate material enabling re-use of the solid particulate material throughout the duration of the treatment cycle. For example, the sealed apparatus may include ducting and pumping means to facilitate the entry and exit of the particulate material from the treatment chamber.

In operation, during a typical treatment cycle comprising one or more phases, the moistened animal substrate can be first placed within the treatment chamber of the sealed apparatus. The treatment formulation and solid particulate material can then be introduced to the treatment chamber. Rotation of the treatment chamber ensures agitation of the animal substrate with the treatment formulation and the solid particulate material. In certain embodiments during the course of agitation by rotation of the treatment chamber, the fluids can pass through an aperture or perforations in the treatment chamber and are returned to the treatment chamber via circulation means. The process of continuous circulation can proceed until the phase in the treatment cycle is completed. In other embodiments, agitation of the animal substrate in the treatment chamber with the treatment formulation can occur without continuous circulation of fluids such that fluids are only permitted to exit the treatment chamber when the phase in the treatment cycle is complete.

In further embodiments, the sealed apparatus can include means to facilitate the easy removal of the solid particulate material after the end of a phase in the treatment cycle or after completion of the treatment cycle. In certain embodiments wherein the treatment chamber includes sufficiently sized perforations, a quantity of the solid particulate material can pass through the perforations along with the fluids. Optionally, the solid particulate material can also be recirculated back into the treatment chamber via recirculation means. In certain embodiments, the treatment chamber can include a vacuum, a blower, a magnet or other appropriate apparatus to facilitate solid particle removal.

The sealed apparatus can be adapted for the subsequent re-use of the solid particulate material and also its storage within the apparatus prior to re-use. In certain embodiments, the solid particulate material can be removed from the sealed apparatus and cleaned before its re-use in an additional phase in the treatment cycle. In further embodiments, the solid particulate material can be replaced before commencing an additional phase in the treatment cycle.

In some embodiments, the animal substrate can comprise a hide, pelt or skin. In one embodiment, the animal substrate can be leather.

The invention will now be further illustrated, though without in any way limiting the scope thereof, by reference to the following examples and associated illustrations.

EXAMPLES

Quantities referred to in the treatment process or for the process medium (which, in some instances, pertains to the treatment formulation) as used herein and throughout the examples are commonly expressed using one or more terms such as float (e.g. dye float), ratios, percentages, w/w (or % w/w) and charges. Unless the context indicates otherwise, these values refer to the quantity of one or more components ("X") in relation to the weight or quantity of the substrate. By means of illustration, expressions such as 100 w/w X, 100% of X and 1:1 substrate:X and the like indicates that the same quantity of X is used as the substrate quantity. Likewise, a 100% "charge" of X or a 100% float of X and the like indicates that the same quantity of X is used as the substrate quantity. Furthermore, expressions such as 50 w/w of X, 50% of X and 1:0.5 substrate:X and the like indicates that the quantity of X used is 50% of the substrate quantity. In addition, a 50% "charge" of X or a 50% float of X indicates that the quantity of X used is 50% of the substrate quantity. Moreover, expressions such as 150 w/w X, 150% of X and 1:1.5 substrate:X and the like indicates that the amount of X used is 150% of the substrate quantity. Likewise, a 150% "charge" of X or a 150% float of X and the like indicates that the quantity of X used is 150% of the substrate quantity. Furthermore, the term "float" can be construed to mean the amount or quantity of water used (which may optionally include one or more organic solvents) excluding any further auxiliaries such as dyes, surfactants or any supplementary chemicals for example.

Example 1—Initial Vegetable Tanning Trial

Vegetable tanning materials, such as Tara and Mimosa, are water extracted from plant leaves, tree bark etc. and represent a traditional method of tanning leather. As a primary tannage, vegetable tanning has been almost completely superseded by chrome tanning methodology, but does have niche applications such as antique book binding. However, vegetable tanning extracts are still commonly used in retanning (secondary tannage) processes used for the production of leathers intended for use in shoe-uppers and furniture. These extracts consist of large acidic polyphenol molecules, and are similar to the tannins found in tea. This vegetable tanning process can be considered as a dehydration of the wet collagen protein, replacing the water molecules with a sheath of vegetable tan molecules.

Matched side samples of a pickled hide (bovine, Scottish Leather Group, UK) were depickled (acid removed) and pretanned with glutaraldehyde (Derugan 3080, Schill & Seillacher GmbH. Germany) tanning agent according to the process outlined as Table 1 below:

TABLE 1

Vegetable tanning process:

| Process steps | Quantities (% w/w) and run time |
|---|---|
| +Pickled samples (thickness, 3.5 mm, pH 2.5) | |
| +Water at 25° C. | 100% |
| +Salt | 5%, Run 10 minute (pH 3.2) |
| +Derugan 3080 | 1%, Run 60 minute (PH 3.5) |
| +Sodium formate (VWR, Lutterworth, UK) | 1.5% (Run 60 minute, pH 5.5) |
| +Sodium bicarbonate (VWR, Lutterworth, UK) | (Run 30 minute, final pH 7.0) |
| +Drain, | |
| +Wash: 200% water at 25° C. | |

Polymeric particles in the form of Teknor Apex™ grade TA101M (Polyester—PET) beads supplied by Teknor Apex UK were used in the trials. Vegetable tanning trials were then carried out with substrate:PET beads:water ratio of 100% w/w:50% w/w:50% w/w. Tanning trials were carried out at pH 6.5 using 10% w/w Tara extract (SilvaTeam, Piedmont, Italy) at 30° C. for two hours. Treatment cycles were carried out in Dose drums (Ring Maschinenbau GmbH (Dose), Lichtenau, Germany) (model 08-60284 with an internal volume of 85 L). Sections of vegetable-tanned samples were taken every 10 minutes during processing, and stained with ethanolic solution containing ferric ammonium sulfate (VWR, Lutterworth, UK). The degree of penetration of tannins was assessed by observing the profile of the dark blue-coloured metal-tannin stain. The polymeric particle assisted process was compared to a control sample without beads having a substrate:water ratio of 50% w/w:50% w/w.

FIG. 1 shows Ferric Ammonium Sulfate stained cross-sections from Optical Microscopy (Model No. VHX-100k, Keyence Corporation, Osaka, Japan) analysis of samples tanned with Tara extract after 30 minutes. Blue-green stains are iron-tannin stains indicating the extent of penetration, whereas light yellow areas are zones where tannins are absent. After 30 minutes, the samples tanned in the PET beads-water system (FIG. 1A) showed an increased penetration and dispersion of tannins into the collagen fibre structure as compared to the corresponding control sample (FIG. 1B), as indicated by a deeper blue-green stain shade. The leathers processed in the PET beads-water system had a uniform grain pattern showing no surface marks or deposition. The initial trial indicated penetration of the Tara tannin was greater after 30 minutes with the PET beads-water system as compared to the control indicating potential for significant reductions in water usage and cycle time.

Example 2A

Initial Chrome Tanning Trial

The tanning step is the essential preservation stage in leather manufacture. The process converts the collagen protein in the raw hide into a stable material that resists putrefaction, and then acts as a foundation for introducing further chemistry that ultimately produces the required aesthetic characteristics of finished leather articles. The vast majority of leather tanning involves chromium III salts, which act by linking and locking the collagen protein strands together.

In this example, matched-side chrome tanning trials were carried out on 3.5 mm thick hide pelts (bovine, Scottish Leather Group, UK). Chrome tanning was carried using 6% (w/w) Chromosal B from Lanxess GmbH, Leverkusen, Germany (25% Chromic oxide, 33% basicity). Treatment cycles were carried out in Dose drums (Ring Maschinenbau GmbH (Dose), Lichtenau, Germany) (model 08-60284 with an internal volume of 85 L).

Experiments were conducted using one set of process mediums additionally comprising polymeric particles in the form of PET beads and one set of process mediums without polymeric particles. Table 2 outlines the beads:water ratios that were used in the trials.

TABLE 2

Bead and water content used in Chrome tanning trials:

| Trial No. | Process Medium: PET beads-water Substrate:Beads:Water (% w/w Ratio) | Process Medium: Control Sample Substrate:Water (% w/w Ratio) |
|---|---|---|
| 1 | 100% Substrate:50% PET beads:50% water | 100% Substrate:50% water |
| 2 | 100% Substrate:75% PET beads:25% water | 100% Substrate:25% water |
| 3 | 100% Substrate:100% PET beads:0% water | 100% Substrate:0% water |

Tanning was carried out according to the process described in Table 3 below.

TABLE 3

Tanning process followed in Chrome tanning trials:

| Process, substrate and chemicals | Remark |
|---|---|
| +Substrate (500 g of pickled hides), dimension 20 cm × 50 cm and average thickness 3.5 mm | pH 2.8 |
| +Process medium for tanning | See Table 2 |
| +6% (w/w) Chromosal B (Tanning salt, 25% $Cr_2O_3$, 33% basicity, Lanxess Gmbh, Leverkusen, Germany) | Run 240 minutes, temperature 35° C. |
| +0.5% (w/w) Sodium bicarbonate | 30 minute |
| +0.5% (w/w) Sodium bicarbonate | 30 minute |
| +0.5% (w/w) Sodium bicarbonate | 30 minute, final pH 4.0 |
| Exhaustion (completion of tannage) | Run 120 minute, temperature 45° C. |

Samples were analysed with digital optical microscopy (Model No. VHX-100k, Keyence Corporation, Osaka, Japan) and a differential scanning calorimeter (DSC). DSC analysis was carried out in a Mettler Toledo 822e DSC and were scanned at 5° C./minute, with reference to an empty weighed, pierced aluminium pan. Thermograms were analysed using Star Software (v 1.13) recording onset/peak temperature and normalised integral.

In these experiments, the water-based (Trials 1 and 2) and waterless (Trial 3) were compared in terms of rate of penetration, cross-sectional profile of chromium (III) in the pelt, shrinkage temperature and surface uniformity of samples.

It was observed that penetration of the tanning salt was rapid in all cases, with complete penetration into 3.5 mm thick pelt samples achieved within 30 minutes. The shrinkage temperature (measured using Differential Scanning calorimetry, DSC) of all samples was greater than 105° C. (wet) showing that tanning was complete in all cases.

Figure 2:
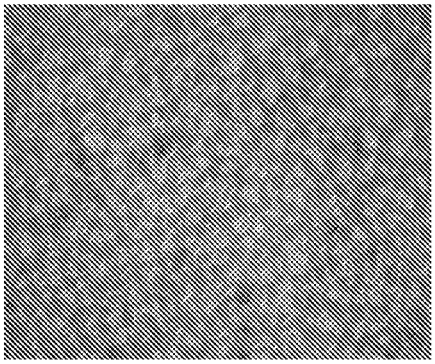
FIG. 2 shows images from an optical microscope at 35× magnification showing pictures of the grain surface of samples from the chrome tanning experiment as outlined in Table 2.
Figure 2:
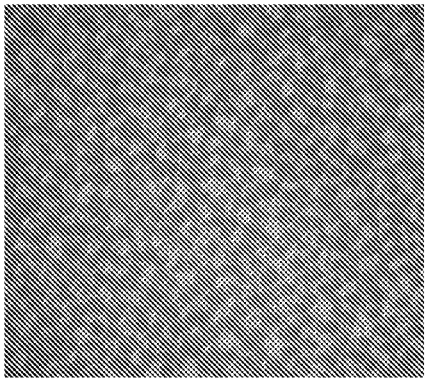
Figure 2:
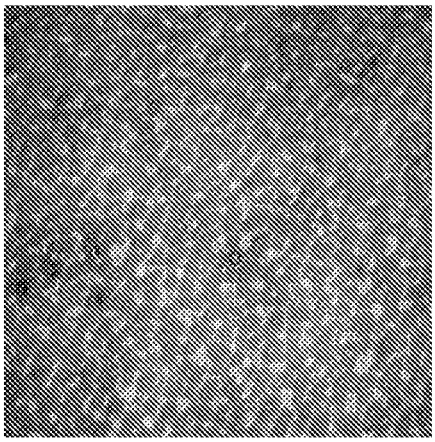
Figure 2:
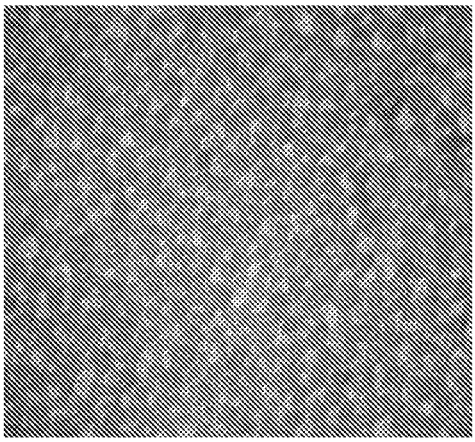

Referring now to FIG. 2, the control samples (i.e. in the absence of beads) in Trials 2 and 3 had a non-uniform surface appearance, showing irregular spots of concentrated chromium salt deposition. In comparison, the PET bead containing samples using 75% beads: 25% water and 100% beads: 0% water did not show the surface chromium salt deposition. Surface spots and unevenness in the control samples, without being bound by theory, were likely to be caused by a fast reaction in the absence of sufficient mechanical action to disperse aggregated chromium (III) tanning salt complex. By contrast, the PET beads were believed to be very effective in ensuring surface levelness and even distribution of the tanning agent throughout the leather hide by acting as an efficient chromium (III) salt disperser due to increased uniform, mechanical action. This enabled uniform and effective tanning in the absence of additional water (see trial 3 in FIG. 2B). The use of polymeric particles in chrome tanning can thus reduce the water consumption of the chrome tanning process by 100%, so that no additional water is required. This has profound implications for the leather industry in that it effectively eliminates chromium containing effluent from the process.

Example 2B

Further Chrome Tanning Trial Using Polymeric Particles

Matched-side chrome tanning trials were carried out on 4.5 mm thick bovine hide/pelts (Scottish Leather Group, UK). For the trials, chrome tanning was carried using 4.5% (w/w) (i.e. a 25% reduction over the conventional 6% w/w usage) Baychrome A from Lanxess GmbH, Leverkusen, Germany (21% Chromic oxide, 33% basicity). A further control sample was processed using the standard chrome amount, 6.0% (w/w) Baychrome A from Lanxess chemicals Ltd UK (21% Chromic oxide, 33% basicity). Tanning was carried out at 55° C., the initial pH was 2.7±0.1 and the final pH was 4.0±0.1. Treatment cycles were carried out in Dose drums (Ring Maschinenbau GmbH (Dose), Lichtenau, Germany) (model 08-60284 with an internal volume of 85 L). Teknor Apex™ grade TA101M (Polyester—PET) supplied by Teknor Apex UK were used in the trials. The ullage (i.e. free space) in the drum for all trials was kept constant at 68%.

To assess whether preservation of the hide occurs, the chrome tanned samples were subjected to a boil test. This determines the temperature at which the tanned leather shrinks; if shrinkage of the chrome tanned leather does not occur at or below 100° C. then the leather is deemed to be satisfactorily preserved. The chrome tanned leather samples were additionally subjected to a differential scanning calorimetry (DSC) test. DSC analysis was carried out in a Mettler Toledo 822e DSC and was scanned at 5° C./minute, with reference to an empty weighed, pierced aluminium pan. Thermograms were analysed using Star Software (v 1.13) recording onset/peak temperature and normalised integral.

Table 4 below shows a comparison of hides tanned with Baychrome A at 4.5% offer using various PET bead:hide substrate:water w/w % ratios.

TABLE 4

Chrome tanning results using boil test and differential scanning calorimetry to confirm preservation:

| Sample | Baychrome A Content (%) | Bead % w/w In Substrate:Bead:Water Ratio | Hide Substrate % w/w In Substrate:Bead:Water Ratio | Water % w/w In Substrate:Bead:Water Ratio | Boil Test (° C.) | DSC Onset Temperature (° C.) |
|---|---|---|---|---|---|---|
| PET beads (X1) | 4.5 | 0.5 | 1.0 | 0.0 | >100 (Pass) | 106.4 (Pass) |
| Low Water Control 1 (LWC1) | 4.5 | 0.0 | 1.0 | 0.0 | 85 (Fail) | 62.0 (Fail) |
| Conventional Water Control 1 (CWC1) | 4.5 | 0.0 | 1.0 | 1.0 | 95 (Fail) | 98.1 (Fail) |
| Standard Conventional Water Control 1 (SCWC1) | 6.0 | 0.0 | 1.0 | 1.0 | >100 (Pass) | 121.7 (Pass) |

If the shrinkage onset temperature was greater than 100° C. (as measured by DSC) then the leather was deemed to have been satisfactorily preserved. The PET beads process (X1) using no additional water and at a reduced chrome offer of 4.5% (i.e. 25% chrome reduction over the standard SCWC1) passed both the boil test and DSC test, whereas both the low water (LWC1) and conventional water controls (CWC1) at a 4.5% chrome offer failed both the boil test and DSC test. This indicated that using polymeric beads, effective chrome tanning can be achieved at both a 25% chrome usage reduction over standard and at the same time using zero additional water (and hence zero chrome effluent).

It should be noted that the standard conventional water control (SCWC1) sample using 6% Baychrome A had a DSC onset temperature significantly in excess of 100° C. Without being bound by theory, this is an indication that a significant excess of chrome is being used to tan the hide, which results in severely environmentally polluting effluent when conventional water quantities are used.

Further trials were conducted using a low water system (i.e. 10% water compared to the conventional standard SCWC1) for the PET beads containing process (X2) and an equivalent low water control (LWC2). The results are shown in Table 5.

TABLE 5

Chrome tanning results using boil test and differential scanning calorimetry to confirm preservation with a low water system:

| Sample | Baychrome A Content (%) | Bead % w/w In Substrate:Bead:Water Ratio | Hide Substrate % w/w In Substrate:Bead:Water Ratio | Water % w/w In Substrate:Bead:Water Ratio | Boil Test (° C.) | DSC Onset Temperature (° C.) |
|---|---|---|---|---|---|---|
| PET Beads (X2) | 4.5 | 0.5 | 1.0 | 0.1 | >100 (Pass) | 103.4 (Pass) |
| Low Water Control 2 (LWC2) | 4.5 | 0.0 | 1.0 | 0.1 | 95 (Fail) | 97.2 (Fail) |
| Conventional Water Control 1 (CWC1) | 4.5 | 0.0 | 1.0 | 1.0 | 95 (Fail) | 98.1 (Fail) |
| Standard Conventional Water Control 1 (SCWC1) | 6.0 | 0.0 | 1.0 | 1.0 | >100 (Pass) | 121.7 (Pass) |

The process including polymeric particles (X2) using low water (i.e. 10% of standard process) and at a reduced Baychrome A offer of 4.5% (i.e. 25% chrome reduction over the standard SCWC1) again passed both the boil test and DSC test, whereas both the low water control equivalent (LWC2) and conventional water controls (CWC1) at a 4.5% chrome offer failed both the boil test and DSC test. This indicated that using polymeric beads, effective chrome tanning can be achieved at both a 25% chrome usage reduction over standard and at the same time using a low water process (i.e. 90% reduced chrome effluent).

Additional trials were conducted using a low water system (i.e. 10% water compared to the conventional standard SCWC1) and increasing quantities of beads for the low water process (X2) compared to the hide substrate and an equivalent low water control (LWC2). The results are shown in Table 6.

TABLE 6

Chrome tanning results using boil test and differential scanning calorimetry to confirm preservation with a low water system and increasing bead content:

| Sample | Baychrome A Content (%) | Bead % w/w In Substrate:Bead:Water Ratio | Hide Substrate % w/w In Substrate:Bead:Water Ratio | Water % w/w In Substrate:Bead:Water Ratio | Boil Test (° C.) | DSC Onset Temperature (° C.) |
|---|---|---|---|---|---|---|
| PET Beads (X2) | 4.5 | 0.5 | 1.0 | 0.1 | >100 (Pass) | 103.4 (Pass) |
| PET Beads (X3) | 4.5 | 0.75 | 1.0 | 0.1 | >100 (Pass) | 105.9 (Pass) |
| PET Beads (X4) | 4.5 | 0.9 | 1.0 | 0.1 | >100 (Pass) | 112.9 (Pass) |
| PET Beads (X5) | 4.5 | 1.0 | 1.0 | 0.1 | >100 (Pass) | 103.8 (Pass) |
| Low Water Control 2 (LWC2) | 4.5 | 0.0 | 1.0 | 0.1 | 95 (Fail) | 97.2 (Fail) |
| Conventional Water Control 1 (CWC1) | 4.5 | 0.0 | 1.0 | 1.0 | 95 (Fail) | 98.1 (Fail) |
| Standard Conventional Water Control 1 (SCWC1) | 6.0 | 0.0 | 1.0 | 1.0 | >100 (Pass) | 121.7 (Pass) |

The processes including polymeric particles (X2, X3, X4 and X5) using low water (i.e. 10% of standard process) and at a reduced Baychrome A offer of 4.5% (i.e. 25% chrome reduction over the standard SCWC1) all passed both the boil test and DSC test, whereas both the low water control equivalent (LWC2) and conventional water controls (CWC1) at a 4.5% chrome offer failed both the boil test and DSC test.

It should be noted that the polymer PET beads from process X2 were then reused in X3, then in X4 and then in X5. This demonstrated that the PET beads can be reused multiple times without a detrimental effect on the beads or the chrome tanning process. Furthermore, the results also indicated a significantly higher DSC onset temperature of 112.9° C. for PET bead trial X4 compared to the other PET bead trials (X2, X3 and X5). This indicated the potential for further chrome usage reductions below 4.5% (i.e. greater than a 25% chrome usage saving) and a preferred polymeric bead:substrate:water ratio of 0.9:1.0:0.1% w/w.

Further experiments were then conducted to determine the chrome concentration in the grain, junction and flesh portions of the chrome tanned hides. The wet-blue leathers were sampled after basification and dried to determine their volatile content according to IUC 5. 400 mg (±100 mg) samples were weighed and digested according to EN ISO 5398-4:2007. Samples were diluted up to 250 mL with ultrapure water and then measured for chromic oxide.

Inductively coupled plasma-optical emission spectroscopy (ICP-OES) was carried out to determine the chromic oxide (and hence chrome concentration) according to BS EN ISO 5398-4: 2007. The instrument was calibrated using a standard solution of potassium dichromate made up to concentrations such that the test specimens would fall within the linear portion of the standard curve. Table 7 indicates the relative amount of chromic oxide in the samples.

TABLE 7

Concentration of Chromium III Oxide in grain, junction and flesh layers when a reduced 4.5% w/w Baychrome A offer is used:

| Sample | Baychrome A Content (%) | Bead % w/w In Substrate:Bead:Water Ratio | Hide Substrate % w/w In Substrate:Bead:Water Ratio | Water % w/w In Substrate:Bead:Water Ratio | Conc. Chrome In Grain Layer (g/100 g Chrome Tanned Hide) | Conc. Chrome In Junction Layer (g/100 g Chrome Tanned Hide) | Conc. Chrome In Flesh Layer (g/100 g Chrome Tanned Hide) |
|---|---|---|---|---|---|---|---|
| PET Beads (X1) | 4.5 | 0.5 | 1.0 | 0.0 | 5.735 | 3.475 | 4.670 |
| Low Water Control 1 (LWC1) | 4.5 | 0.0 | 1.0 | 0.0 | 5.570 | 1.826 | 5.185 |
| Conventional Water Control 1 (CWC1) | 4.5 | 0.0 | 1.0 | 1.0 | 4.611 | 2.983 | 3.628 |

Whilst the chromium Ill oxide concentration for all samples in Table 7 is greater than 3.5 g/100 g in the grain and flesh layers, it is clear that relatively low levels of chrome are present in the denser junction layer (which separates grain from the flesh portions of the hide) for the low water and standard water controls when reduced chrome is used (i.e. LWC1 and CWC1). This inevitably results in these control samples failing the boil and DSC tests as previously shown. This also suggests superior mechanical action/mass transfer effects of using polymeric beads in driving the chrome (especially at reduced usage) into the denser junction layer and hence why the PET bead-based process results in substantially better chrome tanning performance as measured by the boil and DSC tests in reduced chrome and water usage scenarios.

A further experiment was conducted to assess average chrome concentration in the tanned leather including a comparison with an additional control sample with increased chrome concentration. The results are shown in Table 8.

TABLE 8

Comparison of average Chromium III Oxide in tanned hide:

| Sample | Baychrome A Content (%) | Bead % w/w In Substrate:Bead:Water Ratio | Hide Substrate % w/w In Substrate:Bead:Water Ratio | Water % w/w In Substrate:Bead:Water Ratio | Average Concentration Chrome (g/100 g Chrome Tanned Hide) |
|---|---|---|---|---|---|
| PET Beads (X1) | 4.5 | 0.5 | 1.0 | 0.0 | 4.627 |
| Low Water Control 1 (LWC1) | 4.5 | 0.0 | 1.0 | 0.0 | 4.194 |
| Conventional Water Control 1 (CWC1) | 4.5 | 0.0 | 1.0 | 1.0 | 3.741 |
| Standard Conventional Water Control 1 (SCWC1) | 6.0 | 0.0 | 1.0 | 1.0 | 4.039 |

Table 8 demonstrated that the polymeric bead-based process (X1) yields superior chrome tanning performance (evidenced by the higher average chrome concentration in the tanned leather) even when compared to the standard conventional water control (SCWC1), which used 25% more chrome.

Additionally, the percentage of chromium wasted to effluent was calculated for the the conventional water control and standard water control (CWC1 and SCWC1 respectively) compared to the X1 sample as shown in Table 9 below.

TABLE 9

Comparison of chromium wasted to effluent

| Sample | Baychrome A Content (%) | Bead % w/w In Substrate:Bead:Water Ratio | Hide Substrate % w/w In Substrate:Bead:Water Ratio | Water % w/w In Substrate:Bead:Water Ratio | Concentration Chrome Wasted To Effluent (%) |
|---|---|---|---|---|---|
| PET Beads (X1) | 4.5 | 0.5 | 1.0 | 0.0 | 0.0 |
| Conventional Water Control 1 (CWC1) | 4.5 | 0.0 | 1.0 | 1.0 | 7.6 |
| Standard Conventional Water Control 1 (SCWC1) | 6.0 | 0.0 | 1.0 | 1.0 | 12.0 |

It can be seen from Table 9 that significant quantities of chrome are lost to effluent in the absence of PET beads which inevitably results in environmentally hazardous effluent. This also demonstrates the inefficiency of conventional chrome tanning systems compared to the process incorporating polymeric beads. In contrast, the PET bead-based process provides effective chrome tanning at 25% less chrome usage with an absence of environmentally hazardous effluent.

Further experiments were conducted to investigate recycling and reuse of the polymeric beads in chrome tanning experiments. Teknor Apex™ grade TA101M (Polyester—PET) supplied by Teknor Apex UK were used in the trials. It should be noted that the polymer PET beads from process X2 were reused in X3, then in X4, and then in X5 as outlined in the experiments with respect to Table 6 above. These beads were then subjected to differential scanning calorimetry (DSC) to determine whether there had been any composition changes to the beads. DSC analysis was carried out in a Mettler Toledo 822e DSC and was scanned at 15° C./minute, with reference to an empty weighed, pierced aluminium pan. Thermograms were analysed using Star Software (v 1.13) recording onset/peak temperature and normalised integral. The results for the comparison of DSC onset temperatures after multiple tanning trials are shown in Table 10.

TABLE 10

Comparison of DSC onset temperatures for PET Beads after multiple consecutive Chrome tanning trials

| Sample | DSC Onset Temperature (° C.) |
|---|---|
| PET Beads (X3) Before Chrome Tanning | 138.91 |
| PET Beads (X3) After Chrome Tanning | 138.44 |
| PET Beads (X4) Before Chrome Tanning | 136.97 |
| PET Beads (X4) After Chrome Tanning | 138.06 |
| PET Beads (X5) Before Chrome Tanning | 134.01 |
| PET Beads (X5) After Chrome Tanning | 138.68 |

If the DSC Onset Temperature remained within a narrow range then this would indicate that chrome tanning had no adverse effect on the beads and that the beads could be recycled and reused. Indeed, after consecutive chrome tanning trials the DSC onset temperatures for X3, X4 and X5 (after tanning) were all in the 134-139° C. range, which indicated that no significant degradation or chemical modification of the PET beads had occurred. The =5° C. deviation across the results set in Table 10 was thus considered to be within a range accounted for by error associated with the experimental technique alone.

Example 3A

Dyeing Trial

Additional experiments were conducted to establish if polymeric particles could be successfully used in further leather processing steps following tanning. Particularly, to investigate if the polymeric particles could successfully be used in a dyeing process.

Experiments were conducted on bovine crust leathers that were retanned and fat and subjected to a dyeing process. The dyeing of leather during the post tanning stage is almost universal for shoe, garment, upholstery and automotive applications. The general fat liquoring, retanning and dyeing processes were conducted as described below and with reference to Table 11 and Table 12. The retanning and dyeing process described in Table 11 is comparable to that conducted for the preparation of automotive leathers such as those used for car upholstery.

TABLE 11

Retanning and dyeing process without beads:
Material: bovine wet blue
wet blue weight (kg): 10.50
% refer to shaved weight
Substance: 1.4 ± 0.1

| Process | | % | Products | dilution | min. | temp | pH |
|---|---|---|---|---|---|---|---|
| Control process | + | 150 | Water | | | 40 | |
| Neutralisation | + | 2 | Sodium formate | 1.3 | 10 | 40 | |
| | | 1.5 | Sodium bicarbonate | 1.3 | 10 | | |
| | + | 2 | Tanigan PAK | 1.3 | 30 | | 6.0 ± 0.2 |
| retannage | + | 3 | Trupotan RKM | 1:3 | 10 | | |
| | + | 3 | Tanigan OS | 1:3 | 10 | | |
| | | 3 | Mimosa WS | 1:3 | 30 | | 6.0 ± 0.1 |

TABLE 11-continued

Retanning and dyeing process without beads:
Material: bovine wet blue
wet blue weight (kg): 10.50
% refer to shaved weight
Substance: 1.4 ± 0.1

| Process | | % | Products | dilution | min. | temp | pH |
|---|---|---|---|---|---|---|---|
| Dyeing | | 0.5 | Invaderm LU | 1:3 | 10 | 50 | |
| | | 2 | Trupocor dye | | 60 | | |
| Fatliquoring | + | 4 | Truposol LEX | 1:3 | | 50 | |
| | + | 5 | Truposol AWL | 1:3 | 60 | | |
| fixing | + | 0.5 | formic acid | 1:10 | 15 | | |
| | + | 0.5 | formic acid | 1:10 | 15 | | 4.0 ± 0.2 (chk) |
| Drain | | | | | | | |
| Wash (Control) | | 200 | water | | 5 | 40 | |

Chemicals used:

Sodium formate, Sodium bicarbonate and formic acid (VWR international Ltd. Lutterworth, UK); Tanigan PAK (neutralising syntan) and Tanigan OS (replacement syntan) from Lanxess Gmbh. Leverkussen, Germany); Mimosa WS (modified vegetable tannin, SilvaTeam Spa., Piedmont, Italy); Truposol LEX and Truposol AWL (Trumpler Gmbh., Worms, Germany); Invaderm LU (TFL Ledertechnik GmbH, Weil Am Rhein, Germany).

In order to prepare undyed crust leathers, wet-blue hides were retanned and fat liquored according to the process described in Table 11 and Table 12 above. The substrate was treated with an acrylic retanning agent (Trupotan RKM), then a vegetable tannin (Mimosa WS) and followed by dyeing. After dyeing the substrate was fatliquored (Truposol LEX and Truposol AWL), then fixed with formic acid and washed.

Vacuum-dried crust leathers were cut to several equal sized pieces (20 cm×30 cm) having average dry weight of 89 g (±1 g). All of the sample pieces were adjusted to pH 6.2 with treatment cycles carried out in Dose drums (Ring Maschinenbau GmbH (Dose), Lichtenau, Germany) (model 08-60284 with an internal volume of 85 L) following the procedures in Table 11 and 12. Teknor Apex™ grade TA101M (Polyester—PET) supplied by Teknor Apex UK were used in the trials. The ullage (i.e. free space) in the drum for all trials was kept constant at 68%.

The samples were separately dyed with Trupocor Red 2B using 0.5, 1.0, 1.5 and 2.0% w/w of dye offer, i.e. dye quantity calculated based on the wet weight of the undyed crust samples. In each case, the four samples (average wet weight 740 g) and dyeing was carried out with reference to the procedure in Tables 11 and 12 and with a further low water control process as highlighted by the general conditions and steps indicated in Table 13.

TABLE 12

Retanning and dyeing process using PET beads:
Material: bovine wet blue
wet blue weight (kg): 10.50
% refer to shaved weight
Thickness (mm): 1.4 ± 0.1

| Process | | % | Products | dilution | min. | temp | pH | Remarks |
|---|---|---|---|---|---|---|---|---|
| Low water with PET beads | + | 10 | Water | | | 40 | | substrate:water: bead = 10:1:14 |
| | + | 140 | Teknor Apex beads | | | | | |
| Neutralisation | + | 2 | Sodium formate | 1.3 | 10 | 40 | | |
| | | 1.5 | Sodium bicarbonate | 1.3 | 10 | | | |
| | + | 2 | Tanigan PAK | 1.3 | 30 | | 6.0 ± 0.2 | |
| retannage | + | 3 | Trupotan RKM | 1:3 | 10 | | | |
| | + | 3 | Tanigan OS | 1:3 | 10 | | | |
| | | 3 | Mimosa WS | 1:3 | 30 | | 6.0 ± 0.1 | |
| Dyeing | | 0.5 | Invaderm LU | 1:3 | 10 | 50 | | |
| | | 2 | Trupocor dye | | 60 | | | |
| Fatliquoring | + | 4 | Truposol LEX | 1:3 | | 50 | | |
| | + | 5 | Truposol AWL | 1:3 | 60 | | | |
| fixing | + | 0.5 | formic acid | 1:10 | 15 | | | |
| | + | 0.5 | formic acid | 1:10 | 15 | | 4.0 ± 0.2 | |
| Drain | | | | | | | | sample collected for analysis |
| Wash | | 50 | water | | 5 | 40 | | |

Chemicals used:

Sodium formate, Sodium bicarbonate and formic acid (VWR international Ltd. Lutterworth, UK); Tanigan PAK (neutralising syntan) and Tanigan OS (replacement syntan) from Lanxess Gmbh. Leverkussen, Germany); Mimosa WS (modified vegetable tannin, SilvaTeam Spa., Piedmont, Italy); Truposol LEX and Truposol AWL (Trumpler Gmbh., Worms, Germany); Invaderm LU (TFL Ledertechnik GmbH, Weil Am Rhein, Germany).

TABLE 13

| Trupocor Red 2B dye trials: | | |
|---|---|---|
| Control Process 1 | PET Beads-water Process | Control Process 2 |
| Wet samples + water at pH 6.5 = 150% Float (1.2 L) + X % Trupocor Red 2B, Run 60 minutes + 0.5% formic acid, pH 4.0 Dyed leather, vacuum dried | Wet samples + water at pH 6.5 = 10% Float (80 mL) + Teknor Apex PET beads = 140% (1.1 L) + X % Trupocor Red 2B, Run 60 minutes + 0.5% formic acid, pH 4.0 Dyed leather, vacuum dried | Wet samples + water at pH 6.5 = 10% Float (80 mL) + X % Trupocor Red 2B, Run 60 minutes + 0.5% formic acid, pH 4.0 Dyed leather, vacuum dried |

In order to determine the dye concentration of the spent dye liquor and an estimation of dye wastage, samples of the exhausted dye liquors were taken after completion of each dyeing process and the dye concentrations in each sample was determined using a spectrophotometer (CM-2600d, Konica Minolta Europe GmbH, Langenhagen, Germany). Measurements of the colour were made using D65 as an illuminant at a 10° observer angle, with the specular component included. The dye exhaustion percentage values were calculated. Calibration curve for determination of dye concentration was prepared by measuring the absorbance of 0.25, 0.50, 0.75, 1.00 and 1.25 g/L solutions of Trupocor Red 2B (Trumpler GmbH, Worms, Germany) at 530 nm (absorption maxima of the dye). The average concentrations in the spent dye liquors were determined and the ratio of the obtained values to the initial dye concentrations (calculated based on initial dye application) were used to determine the percentage dye exhaustion.

The results for the control process (150% water), PET beads-water process and low water control process (10% water) are shown in Tables 13A, 13B and 13C below.

TABLE 13A

| Control Process 1 (150% water): | | | |
|---|---|---|---|
| Dye % | Quantity of dye used (g) | Quantity Of Dye In Effluent (g) | % Dye Wastage |
| 0.5 | 3.70 | 0.67 | 18.2 |
| 1.0 | 7.40 | 1.28 | 17.3 |
| 1.5 | 11.10 | 1.80 | 16.2 |
| 2.0 | 14.80 | 2.33 | 15.7 |

TABLE 13B

| PET Beads-Water Process (140% beads + 10% water): | | | |
|---|---|---|---|
| Dye % | Quantity of dye used (g) | Quantity Of Dye In Effluent (g) | % Dye Wastage |
| 0.5 | 3.70 | 0.15 | 3.94 |
| 1.0 | 7.40 | 0.26 | 3.49 |
| 1.5 | 11.10 | 0.64 | 5.76 |
| 2.0 | 14.80 | 0.92 | 6.24 |

TABLE 13C

| Control Process 2 (10% water, No beads): | | | |
|---|---|---|---|
| Dye % | Quantity of dye used (g) | Quantity Of Dye In Effluent (g) | % Dye Wastage |
| 0.5 | 3.70 | 0.34 | 9.1 |
| 1.0 | 7.40 | 0.59 | 7.9 |
| 1.5 | 11.10 | 1.93 | 17.4 |
| 2.0 | 14.80 | 2.87 | 19.4 |

The result from dyeing with 10% water relative to substrate weight in the absence of PET beads (control process 2) indicated that a greater quantity of dye is lost to the effluent compared to the process including beads (using 10% water relative to substrate weight) and the conventional process (using standard 150% float relative to substrate weight, i.e. control process 1). The dye wastage to effluent for both the control processes was extremely high compared to the beads-water based process. It was also noted that the samples dyed in 10% water (control process 2 in absence of beads) showed excess dye-deposition at the surface and hence required twice the standard quantity of washing steps, and, furthermore, the dye penetration was also incomplete. Without being bound by theory, this is likely to be due to the greater potential for aggregation of dye particulates at the surface from the concentrated dye solution in the absence of beads. No excess deposition of dyes on the leather surface was observed with the beads-water system, and it is postulated that the beads inhibit dye aggregation at the leather surface in concentrated dye systems thereby allowing more efficient and effective dye diffusion throughout the hide.

Dye penetration was found to be incomplete in all of the samples dyed with 0.5% of dye. Similarly, the control samples with 1% of dye showed undyed portions at the centre of the cross-section. Above 0.5% dye usage, all samples dyed with the beads-water system showed complete penetration. The samples dyed with 1.5% and 2% of dye using the conventional process (control 1) showed complete penetration.

Figure 3:
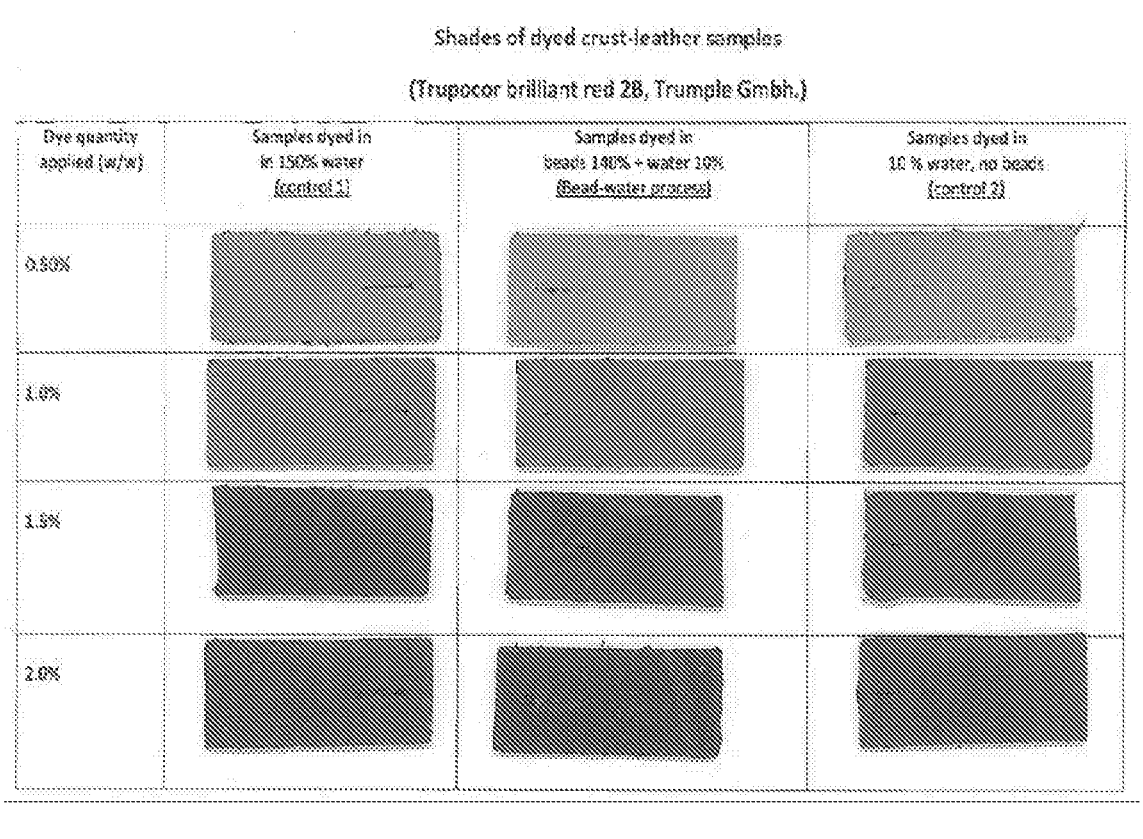
FIG. 3 shows images from an optical microscope of dyed crust-leather samples comparing beads-water and water-based control processes using different Trupocor 2B dye concentrations.

Referring now to FIG. 3, samples were analysed using optical microscopy (Model No. VHX-100k, Keyence Corporation, Osaka, Japan). The samples dyed according to the control 2 process (10% water), as illustrated by the images in the third column, all showed relatively lighter shade at all concentration levels compared to the beads-water process and the conventional control process 1. At 2% dye usage, the beads-water system clearly showed enhanced dye shade compared to the control samples. Furthermore, the beads-water system gave enhanced dyeing at a 93% water saving over the conventional control 1. Dyeing using the conventional process is carried out in a relatively dilute solution to avoid spontaneous fixation and deposition of dye at the surface. This preliminary dyeing experiment has indicated that the dye wastage observed in dyeing process with 150% water (conventional process, Control 1) may be reduced by 50% (at least) if the beads-water process is used. The dramatic reduction of dye wastage in the beads-water process is postulated to be due to increased dye absorption into the hide, which then increased the depth of colour shade. The inclusion of beads in the dyeing process and also using 10% of water compared to the substrate enabled enhanced penetration as well as greater diffusion of the dye into the leather. Whilst the low water control (Control 2) appeared to show improved surface dyeing compared to Control 1, it should be noted that the dye wastage to effluent is significantly higher, making such a process non-viable. This is likely to be due to relatively poor fixation, as the dye appeared to be concentrated at the surface which was removed during washing and subsequent processing, such as vacuum drying.

In addition, the unmilled, vacuum dried samples were analysed by a spectrophotometer (CM-2600d, Konica Minolta Europe GmbH, Langenhagen, Germany) to measure a* (redness) of the sample. The results are shown in Table 13D.

TABLE 13D

Comparison of a* at various Trupocor Red 2B dye concentrations:

| Dye Concentration (% w/w) | Control 1 (150% Water) (a*) | PET beads-water (140% beads, 10% water) (a*) | Control 2 (10% Water) (a*) |
|---|---|---|---|
| 0.5 | 27.20 | 36.28 | 28.84 |
| 1.0 | 30.74 | 39.50 | 37.15 |
| 1.5 | 39.62 | 41.00 | 42.29 |
| 2.0 | 38.74 | 44.00 | 43.23 |

Hue describes colour or shade of colour. It should be noted that the redness (measured by a*) for the beads-water sample using 1% w/w dye is higher than the redness (a*) for the control sample 1 using 2% w/w dye. Additionally, the redness (a*) for the control sample 1 using 1.5% w/w dye is similar to the beads-water sample using 1% w/w dye.

Additionally, the samples were analysed by a spectrophotometer to measure b* (blueness) of the sample. The results are shown in Table 13E.

TABLE 13E

Comparison of b* at various Trupocor Red 2B dye concentrations:

| Dye Concentration (% w/w) | Control 1 (150% Water) (b*) | PET beads-water (140% beads, 10% water) (b*) | Control 2 (10% Water) (b*) |
|---|---|---|---|
| 0.5 | 2.90 | −6.32 | −4.92 |
| 1.0 | 0.02 | −6.76 | −6.28 |
| 1.5 | 0.31 | −5.47 | −6.29 |
| 2.0 | 3.00 | −6.06 | −5.52 |

With reference to Table 13E and Table 13D, as well as having high a* (redness), the beads-water sample also has highly negative b* (blueness) compared to the Control 1. A positive b* for the Control 1 process indicated indicated a yellow hue.

Hue can be determined using the hue angle calculation where:

$$\text{Hue angle } h_{ab} = \text{Arctan } b^*/a^*$$

The Hue angles were thus determined for the various samples and are shown in Table 13F.

TABLE 13F

Comparison of Hue angle at various Trupocor Red 2B dye concentrations:

| Dye Concentration (% w/w) | Control 1 (150% Water) Hue Angle ($h_{ab}$) | PET beads-water (140% beads, 10% water) Hue Angle ($h_{ab}$) | Control 2 (10% Water) Hue Angle ($h_{ab}$) |
|---|---|---|---|
| 0.5 | 0.11 | −0.17 | −0.17 |
| 1.0 | 0.00 | −0.17 | −0.17 |
| 1.5 | 0.01 | −0.13 | −0.15 |
| 2.0 | 0.08 | −0.14 | −0.13 |

Measurement of the Hue angle can allow the chroma to be determined. The Chroma (i.e. the purity or intensity of colour/hue) can be defined as:

$$\text{Chroma } C^*_{ab} = [(a^*)^2 + (b^*)^2]^{0.5}$$

Table 13G below compares the Chroma (i.e. purity or intensity of colour/hue) for the various Trupocor Red 2B dye samples as the dye concentration is increased.

TABLE 13G

Comparison of Chroma at various Trupocor Red 2B dye concentrations:

| Dye Concentration (% w/w) | Control 1 (150% Water) Chroma ($C^*_{ab}$) | PET beads-water (140% beads, 10% water) Chroma ($C^*_{ab}$) | Control 2 (10% Water) Chroma ($C^*_{ab}$) |
|---|---|---|---|
| 0.5 | 27.35 | 36.83 | 29.26 |
| 1.0 | 30.74 | 40.07 | 37.68 |
| 1.5 | 39.62 | 41.36 | 42.76 |
| 2.0 | 38.86 | 44.42 | 43.58 |

As shown in Table 13G, the beads-water samples at dye concentrations from 0.5-2.0% w/w yield a higher chroma (colour/hue intensity) compared to the Control 1 (i.e. conventional process). As noted above for Control 2, there is inadequate dye fixation, surface dye deposition and excessive losses of dye to effluent suggesting that the use of such a water-based dye system would be non-viable.

Figure 4:
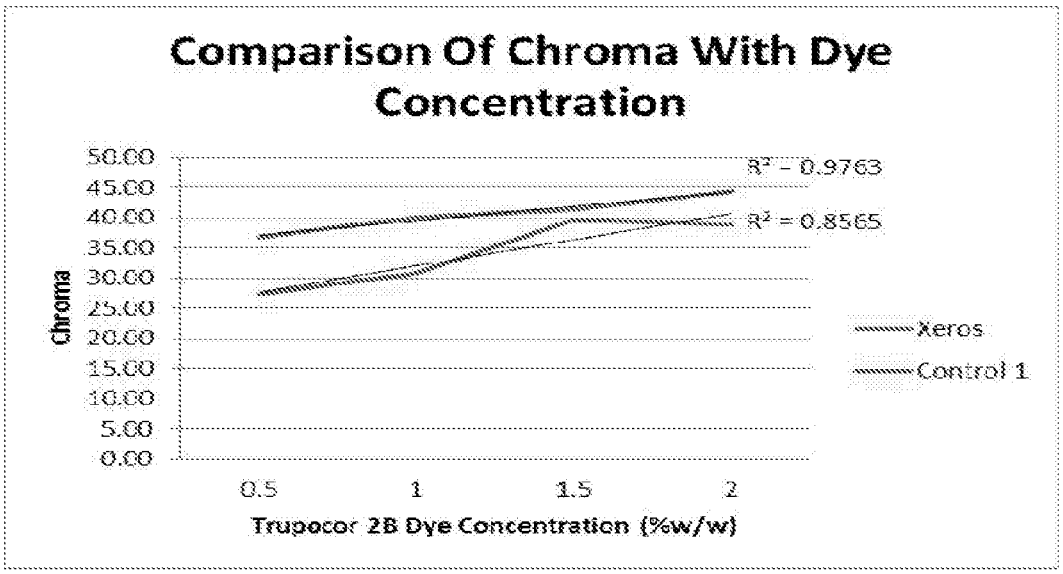
FIG. 4 shows a graph of chroma for the PET beads-water and Control 1 samples at different Trupocor Red 2B dye concentrations. The PET beads-water sample (Xeros) is represented by the upper line with $R^2$ value of 0.9763 and the Control 1 sample is represented by the lower line with $R^2$ value of 0.8565.

Furthermore, as shown In FIG. 4, it can be demonstrated that there is a significantly higher correlation between chroma and dye concentration for the beads-water sample compared to the control. This improved correlation, when combined with a consistent hue angle as the dye concentration increases, has the benefit that a leather manufacturer can potentially control the dyeing characteristics of the finished leather more effectively thereby minimising rework and/or expensive finishing techniques to minimise dyeing variability.

After a drying and milling stage, the PET beads-water sample and corresponding controls from the 2% w/w dyeing experiments were subjected to physical testing as shown in Table 13H.

TABLE 13H

Comparison of physical testing performance following treatment with Trupocor Red 2B dye

| Process | Tear Load (MPa) (BS EN ISO 3376:2011) | Tear Strength (kN/m) (BS EN ISO 3376:2011) | Tensile Strength (BS EN ISO 3376:2011) (MPa) | Elongation At Break (BS EN ISO 3376:2011) (%) | Apparent Density (BS EN ISO 2420:2002) ($g/cm^3$) |
|---|---|---|---|---|---|
| Control 1 | 70.4 | 313.5 | 18.2 | 57.4 | 0.614 |
| PET beads-water | 65.4 | 309.3 | 20.4 | 54.6 | 0.655 |
| Control 2 | 55.8 | 411.0 | 12.1 | 36.4 | 0.624 |

The table above indicated that the PET beads-water treatment produced leather with tear load, tear strength, tensile strength and elongation at break similar to the Control 1 process. The apparent density of the PET beads-water produced leather was slightly denser than the Control 1 process. The physical properties for control 2 were generally inferior than the Control 1 and PET beads-water samples for tear load, tensile strength and elongation at break.

Example 3B

Bead Reuse in Tanning and Dyeing Trial

Additional experiments were conducted to establish if polymeric particles could be successfully recycled and reused for further leather processing steps following their use in chrome tanning. Particularly, to investigate if the polymeric particles could successfully be retained in subsequent retanning and dyeing steps.

The polymer PET beads from X5 as outlined in Table 10 above (having previously been used in 3 consecutive chrome tanning processes) were subsequently used in a further retanning and dyeing process. A first procedure was carried out whereby undyed crust leathers comprising wet-blue hides were retanned with an acrylic retanning agent (Trupotan RKM), then a vegetable tannin (Mimosa WS) following the conditions noted in Table 12 above. After the retanning treatment, the leather substrate was dyed using Trupocor Red 2B with 2.0% w/w of dye offer in accordance with the procedure outlined in Table 12 and Table 13 with respect to Example 3A above.

The PET-beads present in the first retanning procedure were subsequently used in the dyeing step. Samples of the beads from the retanning step and also following their use in the dyeing treatment were subjected to differential scanning calorimetry (DSC) to determine the onset temperature and hence whether there had been any composition changes to the beads. DSC analysis was carried out in a Mettler Toledo 822e DSC and was scanned at 15° C./minute, with reference to an empty weighed, pierced aluminium pan. Thermograms were analysed using Star Software (v 1.13) recording onset/peak temperature and normalised integral.

The DSC onset temperature for the PET beads after the retanning step was measured as 138.38° C. Following dyeing of the substrate using Trupocor Red 2B, the DSC onset temperature was 136.52° C. The DSC onset temperature showed little change and was considered to be within a range accounted for by error associated with the experimental technique alone. The results indicated that dyeing with Trupocor Red 2B did not cause degradation or chemical modification of the PET beads demonstrating that the beads could be recycled and reused in subsequent retanning and dyeing processes even after their earlier use in chrome tanning.

Example 4—Further Tanning Studies Conducted on Goatskins

Goatskin of UK origin (Latco Ltd, Cheshire, UK) was subjected to beamhouse operations including soaking, reliming, deliming, bating and pickling before the tanning stage. The beamhouse and tannage processes for the goatskins are summarised in Table 14 below.

TABLE 14

Beamhouse and tannage for goatskins: % refers to substrate weight

| Process | % | Chemical | T (° C.) | Time | Comments |
|---|---|---|---|---|---|
| Soaking | 400 | Water | 26 | | |
| | 3 g/L | Eusapon OC | | | |
| | 1 g/L | Preventol Z-L | | 6 h | |
| Drain | | | | | |
| Green Flesh, Paint unhairing | | | | | |
| Leave for 3 h, pull and reweigh | | | | | |
| Reliming | 400 | Water | 24 | | |
| | 0.1 | Eusapon OC | | | |
| | 0.2 | $Na_2S$ | | | |
| | 1.5 | Lime | | 20 h | 5'/60' |
| Drain | | | | | |
| Wash | 200 | Water | 35 | 10 min | |
| Drain | | | | | |
| Wash | 200 | Water | 35 | 10 min | |
| Drain | | | | | |

TABLE 14-continued

| | | | | | |
|---|---|---|---|---|---|
| Deliming | 100 | Water | 35 | | |
| | 2.5 | Ammonium chloride | | | phenolphthalein, pH |
| | 0.3 | Sodium m-bisulphite | | 45 min | |
| Bating+ | 0.5 | Oropon ON2 | | 120 min | Thumb print |
| Drain | | | | | |
| Washing | 200 | Water | Cold | 10 min | |
| Drain | | | | | |
| Pickling | 50 | Water | 35 | | |
| | 5 | Sodium chloride | | 5 min | |
| + | 0.8 | Sulphuric acid (1:10) | | 120 min | pH |
| | 0.8 | Formic acid (1:10) | | | bromocresol green |
| Tanning+ | 4.5 | Baychrome A | | | Run till penetrated and then start heating cycle |

Eusapon ® and Baychrome ® - BASF SE, Ludwigshafen, Germany; Oropon ® - TFL Ledertechnik GmbH, Weil Am Rhein, Germany Treatment cycles were carried out in Simplex-4 drums (Inoxvic, Barcelona, Spain). Tanning trials were conducted both in the presence of particles and in the absence of particles. A series of polymeric and non-polymeric particles were independently used in separate experiments, the particles having the characteristics outlined in Table 15. For chrome tanning a substrate:particles: water % w/w ratio of 1.0:0.9:0.1 was used as a basis for the trials, calculated on the assumption that Teknor Apex PET beads were used. Particle surface area was normalised (assuming that the Teknor Apex PET surface area had a relative surface area of 1.0) so that identical particle surface area was presented to the skin for each of the particles used. Two control samples were additionally included, a conventional water control (CWC) wherein the water content equated to that described in Table 14 for the relevant respective process step and a low water control (LWC) based on a substrate:water % w/w ratio of 1.0:0.1 (i.e. equivalent to the quantity of water used for the particle assisted process).

Ceramic beads (Ceramic baking beans grade, Lakeland Limited, Windermere, UK), Squash balls (Unsquashable squash ball grade, Sports Ball Shop, Garford, UK), glass beads (Worf Glaskugeln GmbH, Mainz, Germany), ball bearings (large) and ball bearings (small) (JS Ramsbottom, Poulton Le Fylde, UK) were used as supplied.

Samples were collected for differential scanning calorimetry (DSC) after the tanning and basification operation, ensuring the samples were free of flesh and with hair follicles as free of hair root as possible. After conditioning the wet-blue hide for 12 hours the damp wet-blue hide was sectioned into 3 mg (±1 mg) specimens that contained equal proportion of grain/fibre layer. Specimens were sealed in aluminium pans after the pan and specimen weight had been recorded.

DSC analysis was carried out in a Mettler Toledo 822e DSC and were scanned at 5° C./minute, with reference to an empty weighed, pierced aluminium pan. Thermograms were analysed using Star Software (v 1.13) recording onset/peak temperature and normalised integral. Table 16 indicates the onset temperatures implying the shrinkage temperature for the various particle and non-particle assisted treatments.

TABLE 15

Comparison of different particle types used in the treatment process:

| Particle | Composition | Shape | Longest Dimension (mm) | Medium Dimension (mm) | Shortest Dimension (mm) | Density ($g/cm^3$) | Surface Area Per Particle ($mm^2$) |
|---|---|---|---|---|---|---|---|
| Glass | Glass | Spherical | 4.71 | 4.71 | 4.71 | 3.49 | 69.7 |
| Ceramic (Baking) beads | Ceramic | Ellipsoid | 10.53 | 10.07 | 10.04 | 2.31 | 327.9 |
| Ball Bearings (Small) | Steel | Spherical | 4.36 | 4.36 | 4.36 | 7.86 | 59.8 |
| Ball Bearings (Large) | Steel | Spherical | 5.49 | 5.49 | 5.49 | 8.22 | 94.6 |
| Squash Balls | Rubber | Spherical | 39.7 | 39.7 | 39.7 | 0.74 | 4937.3 |
| Teknor Apex PET 101 | PET | Ellipsoid | 4.24 | 3.67 | 3.34 | 1.365 | 44.26 |
| Sabic PP | Polypropylene | Cylindrical | 4.22 | 3.97 | 3.50 | 0.66 | 71.4 |
| Technyl XA1493 | Nylon 6,6 | Ellipsoid | 4.79 | 3.59 | 3.29 | 1.496 | 47.16 |

TABLE 16

Differential scanning calorimetry results to indicate preservation of chrome tanned substrates following processing with polymeric and non-polymeric particles:

| Sample | Onset Temperature (° C.) |
|---|---|
| Conventional water control (CWC) - Mean | 115.77 |
| Low water control (LWC) - Mean | 116.12 |
| Ceramic beads | 118.10 |
| Glass beads | 114.91 |
| Squash balls | 115.94 |
| PET | 116.99 |
| Polypropylene | 116.15 |
| Nylon 6,6 | 117.52 |

The data from Table 16 suggests that as the shrinkage temperatures were all greater than 100° C., then this would indicate that all particle types tested (including polymeric and non-polymeric particles) could be used in the tanning and basifying stages to give satisfactorily tanned leather.

In a supplementary experiment, the chrome tanned leathers were sampled after tanning and basification and dried to determine their volatile content according to IUC 5. 400 mg (±100 mg) samples were weighed and digested according to EN ISO 5398-4:2007. Samples were diluted up to 250 mL with ultrapure water and then measured for chromic oxide content.

Inductively coupled plasma-optical emission spectroscopy (ICP-OES) was used to determine the chromic oxide according to BS EN ISO 5398-4: 2007. The Thermo iCAP 6000 Series instrument was calibrated using a standard solution of potassium dichromate made up to concentrations such that the test specimens would fall within the linear portion of the standard curve. The results are shown in Table 17.

TABLE 17

Chromic Oxide content of chrome tanned substrates following processing with polymeric and non-polymeric particles

| Sample | $Cr_2O_3$ (%) |
|---|---|
| Conventional water control (CWC) - Mean | 3.46 |
| Low water control (LWC) - Mean | 3.16 |
| Ceramic beads | 3.00 |
| Glass beads | 4.18 |
| Squash balls | 4.35 |
| PET | 3.24 |
| Polypropylene | 3.21 |
| Nylon 6,6 | 3.85 |

The chromic oxides levels shown in Table 17 are indicative of the effect particles have on the skins processed. The polymeric and non-polymeric particles can produce leathers of comparable chromium contents in relation to the conventional water controls. Thus it can be shown that non-polymeric as well as polymeric particles can be used during the chrome tanning phase to produce satisfactory chrome tanned leather.

Example 5—Use of Polymeric and Non-Polymeric Particles in Beamhouse Processes Prior to Tanning Investigations were carried out to assess the impact of the use of particles for the processing of goatskins in stages prior to tanning. Goatskins were thus processed without particles from the soaking to reliming stages in accordance with the conditions set out in Table 14 above. The deliming, bating and pickling stages were then performed either with particles or without particles as controls. Treatment cycles were carried out in Simplex-4 drums (Inoxvic, Barcelona, Spain). A series of polymeric and non-polymeric particles were independently used in separate experiments, the particles having the characteristics outlined in Table 15. For each of the deliming, bating and pickling stages, a substrate:particles: water % w/w ratio of 1.0:0.9:0.1 was used as a basis for the trials, calculated on the assumption that Teknor Apex PET beads were used. Particle surface area was normalised (assuming that the Teknor Apex PET surface area had a relative surface area of 1.0) so that identical particle surface area was presented to the skin for each of the particles used. Two control samples were additionally included for each stage, a conventional water control (CWC) wherein the water content equated to that described in Table 14 for the relevant respective process step and a low water control (LWC) based on a substrate:water % w/w ratio of 1.0:0.1 (i.e. equivalent to the quantity of water used for the particle assisted process). All the samples were then processed during the tanning and post tanning stages without particles.

Samples were collected for differential scanning calorimetry (DSC) after the tanning and basification operation, ensuring the samples were free of flesh and with hair follicles as free of hair root as possible. After conditioning the wet-blue hide for 12 hours the damp wet-blue was sectioned into 3 mg (±1 mg) specimens that contained equal proportion of grain/fibre layer. Specimens were sealed in aluminium pans after the pan and specimen weight had been recorded.

DSC analysis was carried out in a Mettler Toledo 822e DSC and were scanned at 5° C./minute, with reference to an empty weighed, pierced aluminium pan. Thermograms were analysed using Star Software (v 1.13) recording onset/peak temperature and normalised integral. Table 18 indicates the onset temperatures implying the shrinkage temperature for the various particle and non-particle assisted treatments.

TABLE 18

Differential scanning calorimetry results to indicate preservation of chrome tanned substrates following processing with polymeric and non-polymeric particles in the deliming, bating and pickling stages:

| Sample | Onset Temperature (° C.) |
|---|---|
| Conventional water control (CWC) - Mean | 115.77 |
| Low water control (LWC) - Mean | 116.12 |
| Ceramic beads | 118.10 |
| Glass beads | 114.91 |
| Squash balls | 115.94 |
| Ball bearings (small) | 114.51 |
| Ball bearings (large) | 115.15 |
| PET | 116.99 |
| Polypropylene | 116.15 |
| Nylon 6,6 | 117.52 |

The data in the table above shows that there is very little difference between the controls and the experimental specimens. As the shrinkage temperatures were all greater than 100° C., then this would indicate that all particle types tested (including polymeric or non-polymeric particles) could be used during deliming/bating and pickling stages without any detrimental impact on the effect of the tannage.

Example 6—Further Studies Showing Use of Polymeric Particles in Beamhouse Processes Prior to Tanning In an additional series of experiments, the use of polymeric particles in the processing stages prior to the tanning step were investigated. Wet salted hides (bovine) were cut to matched equal sized pieces (approx. 20 cm×30 cm) having average dry weight of 90 g (±1 g). Treatment cycles were carried out in Dose drums (Ring Maschinenbau GmbH (Dose), Lichtenau, Germany) (model 08-60284 with an internal volume of 85 L). The polymeric particles used in the processes were Teknor Apex™ grade TA101M (Polyester—PET) supplied by Teknor Apex UK. The hides were subjected to a dirt soak using 200% water, 1 g/L soap (Eusapon OD) and 0.75 g/L bactericide (Preventol Z-L) for 2 hours. The samples were then subjected to a main soak for 4 hours using 200% water, soap (Eusapon OD) soaking enzyme (Trupowet PH), and bactericide (Preventol Z-L). The chemical usage figures for the particle assisted process versus conventional process is indicated below.

TABLE 19 reagents and quantities used in soaking stage:

| Process | Water (% weight on wet salted hide) | PET Beads (% weight on wet salted hide) | Soap (% weight on wet salted hide) | Bactericide (% weight on wet salted hide) | Soaking Enzyme (% weight on wet salted hide) |
|---|---|---|---|---|---|
| Particle assisted | 100 | 100 | 0.2 | 0.3 | 0.8 |
| Conventional | 200 | 0 | 0.5 | 0.3 | 0.8 |

Thus in the soaking process using polymeric particles, a 50% reduction in water usage and 60% soap usage was facilitated.

After draining and fleshing, the samples were subjected to liming using the following reagents and quantities.

TABLE 20 reagents and quantities used in liming:

| Process | Process Water (% weight on wet salted hide) | PET Beads (% weight on wet salted hide) | Lime (g/L) | Sodium Sulphide (g/L) | Wash Water (% weight on wet salted hide) |
|---|---|---|---|---|---|
| Particle assisted | 185 | 100 | 24 | 26 | 300 |
| Conventional | 280 | 0 | 30 | 30 | 400 |

The liming process including polymeric particles allowed a 33.9% reduction in process water and 25% reduction in wash water, and in addition, a 20% lime usage and 13.3% sodium sulphide reduction.

Samples obtained from each process were then treated with 3% ammonium chloride (VWR, Lutterworth, UK) and 0.5% sodium metabisulphite (VWR, Lutterworth, UK) in a deliming process for 50 minutes which was then followed by a bate treatment (Oropon, 0.2%) for 40 minutes followed by a wash (100% water).

The samples were then pickled for 90 minutes using the reagents and amounts in the following table:

TABLE 21 reagents and quantities used in pickling:

| Process | Process Water (% weight on limed hide) | PET Beads (% weight on limed hide) | Salt (% weight on limed hide) | Sodium Formate (% weight on limed hide) | Sulphuric Acid (% weight on limed hide) | Fungicide (Busan 30WB) (% weight on limed hide) | Catalix (% weight on limed hide) |
|---|---|---|---|---|---|---|---|
| Particle assisted | 25 | 75 | 3.0 | 0.8 | 1.5 | 0.16 | 1.0 |
| Conventional | 50 | 0.0 | 5.0 | 1.0 | 1.8 | 0.16 | 1.0 |

The particle assisted pickling process enabled a 50% reduction in process water, a 40% reduction in salt, and in addition, a 20% sodium formate (VWR, Lutterworth, UK) and 16.7% sulphuric acid (VWR, Lutterworth, UK) usage reduction compared to the standard conventional process.

The samples were then chrome tanned conventionally with 6% chrome tanning salt (25% chromium oxide, 33% basicity) and after full penetration was achieved 0.5% magnesium oxide was added to fix the chrome. After running overnight, the particle assisted and conventional samples had a pH 3.9±0.1. Both the particle assisted and conventional samples achieved a boil test result greater than 100° C. which indicated satisfactory leather preservation had occurred.

Thus it can be seen that a significant reduction in beamhouse chemicals, water usage and effluent can be achieved using a particle assisted process compared to a conventional process.

Example 7—Carbon Dioxide Deliming Trial Using Polymeric Particles

Samples of unsplit limed hide (bovine, Scottish Leather Group, UK) were first prepared according to a conventional process as described in Table 22 below.

TABLE 22

Conditions and reagents for preparing a limed bovine hide:
Material: Wet salted hide (UK origin)
Weight in kg 20.0
% refer to salted weight
Thickness 3.5 mm
Process vessel: Soaking and Liming: wooden drum diameter 1.4 m.

| Process | % | Products | ° C. | dil. | run (min) | rest (min) | rpm | Remarks |
|---|---|---|---|---|---|---|---|---|
| Presoaking | 200.0 | Water | 25 | | | | | |
| | 0.1 | Eusapon OD | | 1:3 | 120 | | 4 | |
| Drain, wash | | | | | | | | Drain |
| Soaking | 150.0 | Water | 25 | | | | | |
| | 0.1 | Busan | | 1:3 | | | | |
| | 0.2 | Eusapon OD | | 1:3 | | | | |
| | 0.5 | Sodium carbonate | | | 120 | | 2 | pH: 9.5-9.8 |
| | Automatic | (for 12 hours) | | | 10 | 50 | | pH: >9.0 |
| | | | | | | | | Drain, wash |
| Fleshing | | | | | | | | |
| Liming | 50.0 | Water | 25 | | | | | |
| | 0.9 | Eusapon OD | | 1:3 | | | 4 | |
| + | 1.0 | Sodium hydrosulphide | | | 30 | | | |
| | 0.2 | Aglutan PR | | | 30 | | | |
| | 1.0 | Hydrated lime | | | 30 | 30 | 4 | |
| | 50.0 | Water | | | | | | |
| + | 1.0 | Sodium sulphide | | | | 30 | 4 | |
| | 1.0 | Hydrated lime | | | 45 | | | |
| | 50.0 | Water | | | | | | |
| | 1.0 | Sodium sulphide | | | | | | |
| | 1.0 | Hydrated lime | | | 45 | | 4 | |
| | 100.0 | Water | | | | | | |
| | 2.0 | Hydrated lime | | | | | | |
| | 0.2 | Silastol R687 | 25 | | 60 | | | |
| | Automatic | (for 20 hours) | | | 5 | 55 | 4 | pH 12.5-12.6 |
| Wash (2X) | 100.0 | Water | 25 | | | | | |
| | 0.2 | Lime | | | 15 | | 2 | Drain |

Speciality Chemicals
Eusapon OD (General surfactant and wetting agent, BASF aktiengesellschaft, Ludwigshafen Germany), Silastol R687 (degreasing agent, Schill & Seilacher Gmbh, Germany), Aglutan PR (enzymatic liming auxilliary, Schill & Seilacher Gmbh, Germany)

Matched-side samples of the limed hide (of thickness 4.5±0.2 mm, with dimensions of 20 cm×45 cm and average weight of 750 g) were then treated for 3 hours at 25° C. in Dose drums (Ring Maschinenbau GmbH (Dose), Lichtenau, Germany) (model 08-60284 with an internal volume of 85 L) with carbon dioxide. The gas was delivered at controlled rates: 2.5 L/min for initial purging for 5 minutes and 0.25 L/min as steady flow for deliming. The carbon dioxide was supplied by BOC UK Ltd, a division of Linde AG, Munich, Germany.

Teknor Apex™ grade TA101M (Polyester—PET) supplied by Teknor Apex UK were used in the trials. In the trial, a total float (beads plus water) of 100% on the weight of the pelt was used, and the weight ratio of substrate:beads: water was 100% w/w: 75% w/w: 25% w/w. A matching control sample was processed with equal amount of water (i.e. substrate:water was 100% w/w: 25% w/w) but without beads.

Samples (ca. 3 cm×3 cm) were taken every 30 minute and instantly frozen with liquid nitrogen. The samples were later thawed and stained with phenolphthalein indicator solution to assess the progress of deliming. Optical microscopy analysis (Model No. VHX-100k, Keyence Corporation, Osaka, Japan) was carried out on the cross-section of the samples.

Phenolphthalein (VWR, Lutterworth, UK) staining of the pelt gives a pink colour when the pH in the cross-section is greater than 8.5. The depth of the pink colour shows the degree of alkalinity. A white pelt colour (i.e. absence of pink) is indicative of complete deliming.

Figure 5:
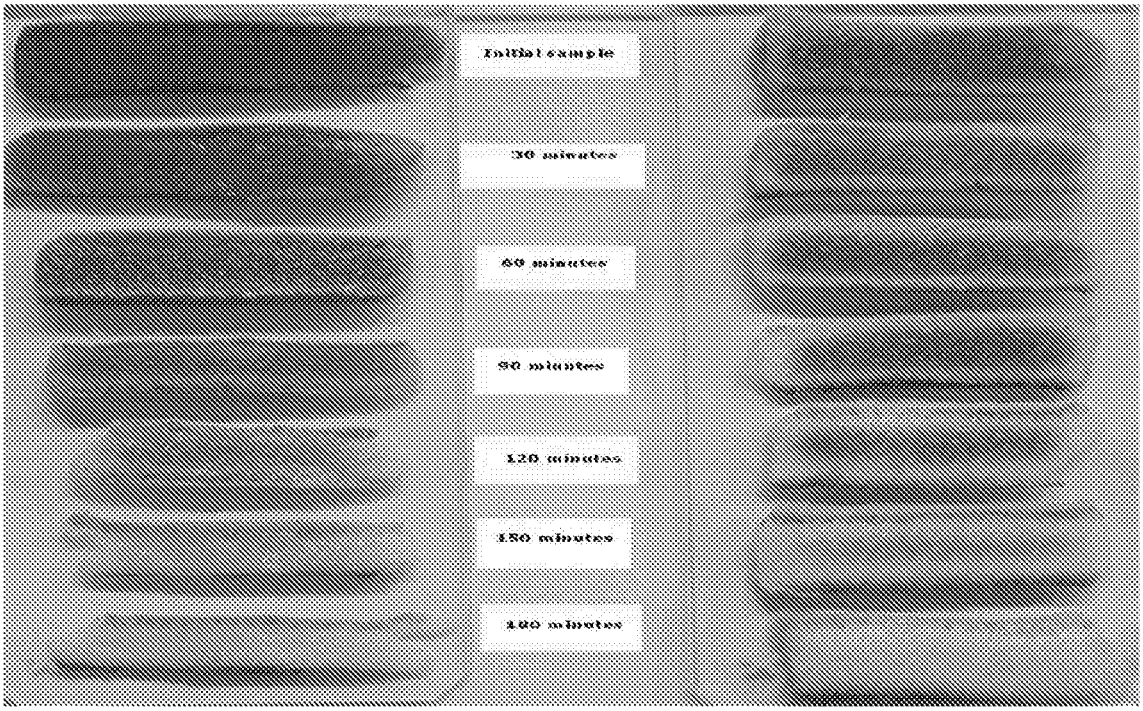
FIG. 5 shows images from an optical microscope of a cross-section of delimed pelt stained with alkaline phenolphthalein indicator solution. The image on the left shows a control sample delimed with water (i.e. substrate:water was 100% w/w: 25% w/w) and the image on the right shows a sample delimed with PET beads (i.e. substrate:beads:water was 100% w/w: 75% w/w: 25% w/w).

Referring now to FIG. 5, phenolphthalein staining indicated that complete deliming of full-thickness limed hide was achieved in 3 hours by using a process medium comprising substrate:PET beads:water ratio of 100% w/w:75% w/w:25% w/w (i.e. all percentages calculated based on the weight of the limed hides). Deliming in the control sample was incomplete and still indicated residual alkalinity, as shown by residual pink colouration.

It was also observed that the deliming action progressed faster from the start of the process with PET beads compared to the control, suggesting that the beads increase the absorption of carbon dioxide leading to rapid neutralization. Carbon dioxide deliming of full thickness hide typically takes 4 hours and even more in industrial applications. The experiment therefore indicated that effective carbon dioxide deliming could be achieved with a 75% water saving using polymeric beads, and with a cycle time reduction of around 25%.

Example 8—Fat Liquoring Process Using Polymeric Particles

Almost all leather requires a greater softness, suppleness and flexibility than is imparted by the tanning (preservation) stage, particularly for shoes, garments and upholstery applications. This is attained in the fat liquoring process by introducing oils into the leather in the form of dispersed emulsions, so that individual tanned collagen fibres are uniformly coated and lubricated. The oil is generally introduced as an emulsion with water. The properties of the leather can be varied by controlling the degree of penetration of the oil-in-water emulsions (derived from the fatliquor). By concentrating the bulk of the fat liquor in the surface areas, soft but resilient leathers with tight grain surface appearance can be produced. This is typical of shoe leathers. In contrast, if the fat liquor is allowed to penetrate fully and uniformly, the leather will be even softer and also stretchy with a more natural grain surface appearance, which would be more appropriate for garments.

Fatliquoring experiments were carried out on previously chrome-tanned hides (bovine, UK origin) uniformly neutralised to pH 5.5. Teknor Apex™ grade TA101M (Polyester—PET), supplied by Teknor Apex UK, were used in the trials. The trials were carried out in a process medium (float) composed of substrate:PET beads:water ratio of 100% w/w: 75% w/w:25% w/w (i.e. 1.0:0.75:0.25), and matched side control samples were processed in the same quantity of water (i.e. 25% on substrate weight) without using beads. Treatment cycles were carried out in Dose drums (Ring Maschinenbau GmbH (Dose), Lichtenau, Germany) (model 08-60284 with an internal volume of 85 L).

A trial was conducted using sulfited fatliquor Corilene N60 (Stahl Europe BV, Barcelona, Spain) 7.5% w/w based on chrome tanned leather (wet-blue) weight, which was applied at pH 5.5 and 40° C. over a period of 60 minutes, with samples taken every 15 minute for analysis. Cross-sections of fatliquored samples were dehydrated with ethanolic solutions, stained for 24 hours with Sudan IV hydrophobic stain solution (VWR, Lutterworth, UK) and assessed with an optical microscope (Model No. VHX-100k, Keyence Corporation, Osaka, Japan).

Figure 6:
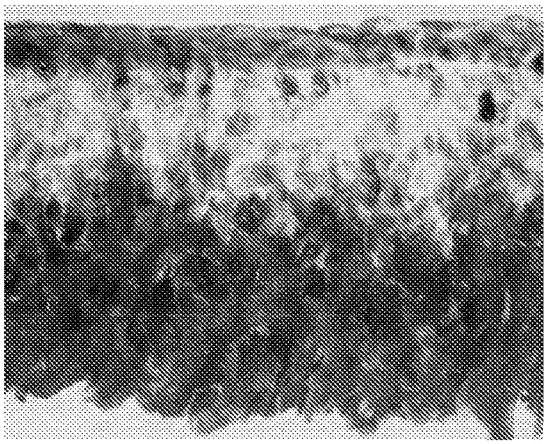
FIG. 6 shows images from an optical microscope for chrome tanned leathers fat liquored with sulfited oil emulsion for 15 Minutes comparing (A) control sample with substrate 100%: 25% water and (B) PET beads-water sample with 100%: 75%: 25% Substrate:Beads: Water.
Figure 6:
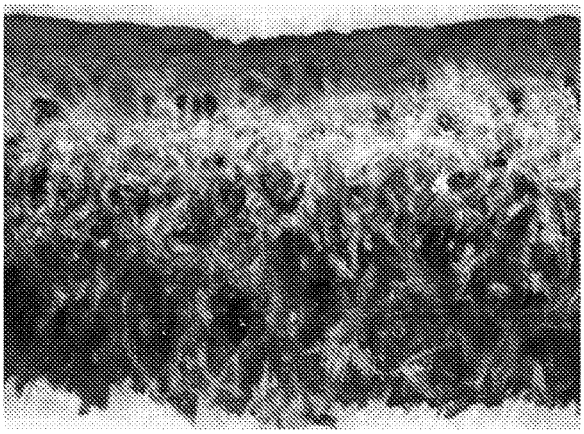

Referring now to FIG. 6, the differences in fatliquor distribution through the cross-section of the samples for the control (i.e. fatliquored in water) and the water/bead system is shown in FIGS. 6A and B. Red-stained areas show fatliquored areas of the cross-section where there is increased deposition of fibre lubricating oils, whereas grey/white areas are unfatliquored. Fatliquoring of samples using sulfited fatliquors showed a significant improvement in the rate of penetration and absorption of the emulsions into the fibre structure with PET beads. The fatliquor penetration was enhanced by improved dispersibility in the beads-water system that prevented coalescence of the emulsions. Without being bound by theory, it is postulated that the beads produced a finer micro-emulsion which aided penetration.

Additionally, a trial was conducted using sulfated fatliquor Trupon DXV (Trumpler GmbH, Worms, Germany), 7.5% w/w based on chrome tanned leather (wet-blue) weight, applied at pH 5.5 and 40° C. over a period of 60 minutes, with samples taken every 15 minute for analysis. Cross-sectional sample slices of fatliquored samples were dehydrated with ethanolic solutions, stained for 24 hours with Sudan IV hydrophobic stain solution (VWR, Lutterworth, UK) and assessed with an optical microscope (Model No. VHX-100k, Keyence Corporation, Osaka, Japan).

Figure 7:
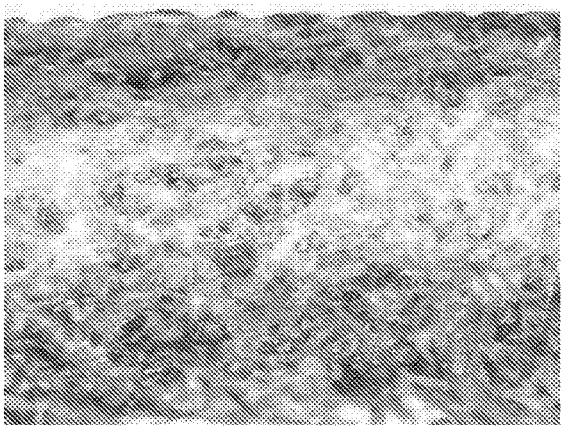
FIG. 7 shows images from an optical microscope for chrome tanned leathers fat liquored with sulfated oil emulsion for 30 Minutes comparing (A) control sample with substrate 100%: 25% water and (B) PET beads-water sample with 100%: 75%: 25% Substrate:Beads: Water.
Figure 7:
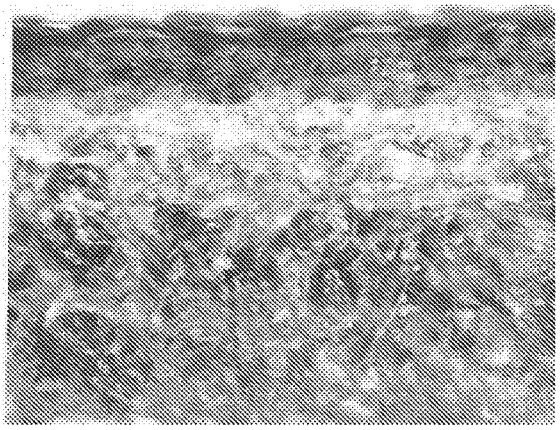

Referring now to FIG. 7, there is shown a comparison of the rate of penetration of fatliquor was based on Optical Microscopy measurement (in microns) of fatliquored (red stained) and unfatliquored (unstained) portions of sample sections. In the case of the sulfated fat liquor, the stained samples showed greater initial penetration in the first 30 minutes with the PET beads-water samples (FIG. 7B) as compared to the control (FIG. 7A).

Emulsions of sulfated oils are generally unstable in the presence of the cationic charge of the chrome-tanned leather, giving emulsion instability. In conventional processes however, sulfated oils are applied almost universally in a mixture with sulfited oils, which nullifies the issue of emulsion instability. If necessary, the application of sulfated oils in the beads-water system for fatliquoring chrome-tanned leather can also be facilitated by 'pre-fatliquoring' with sulfited oils. Nevertheless, fatliquoring of less cationic leathers (e.g. vegetable tanned, vegetable/syntan retanned) can be carried out effectively using sulfated fat liquors in the PET beads-water system. Substrate:Beads:Water systems in the ratio of 100%:75%:25% (i.e. 75% water saving compared to the control sample which used conventional water charges) can be applied in the fatliquoring operation of the post tanning process, with an additional benefit of approximately a 50% reduction in process time using sulfited fatliquors and in the case of combined sulfited-sulfated fat liquors mixtures.

It is clear that the bead-water systems can enhance penetration of the oil-in-water emulsions into the fibre structure. Sulfited fatliquors in particular were completely absorbed in the chrome-tanned leather with approximately a 50% reduction in cycle time using substrate:beads:water ratio (100%: 75%:25%). This gives significant water savings (potentially of at least 75%) over the current conventional water efficient processes. Conceivably, the process time for fatliquoring could be reduced by at least 50% and possibly up to 75%, particularly with the use of sulfited oils.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A method for treating an animal substrate comprising: agitating a moistened animal substrate with an aqueous treatment formulation and a solid particulate material in a sealed apparatus, wherein the treatment formulation comprises at least one treatment agent selected from the group consisting of tanning agents, re-tanning agents and tannery process agents, wherein the solid particulate material has an average particle diameter of from 1 mm to 500 mm and/or a length of from 1 mm to 500 mm, and wherein the animal substrate is hide, skin, or leather, and wherein the particles are re-used at least once in a subsequent method for treating an animal substrate comprising agitating the moistened animal substrate with said treatment formulation and said solid particulate material in a sealed apparatus.

2. A method as claimed in claim 1 wherein the tannery process agent comprises a chemical used in the treatment of an animal substrate in one or more tannery processes selected from cleaning, curing, beamhouse treatments including soaking, liming, unhairing, scudding, fleshing, deliming, bating, pickling and fat liquoring, enzyme treatment, and dye fixing.

3. A method as claimed in claim 2 wherein the tannery process agent comprises a chemical used in the treatment of an animal substrate in one or more tannery processes selected from cleaning, liming, deliming and enzyme treatment.

4. A method as claimed in claim 1 wherein the tanning or retanning agent is selected from vegetable tanning or retanning agents and chromium III salts.

5. The method as claimed in claim 1 wherein the sealed apparatus comprises a treatment chamber in the form of a rotatably mounted drum or a rotatably mounted cylindrical cage and wherein the method comprises agitating said animal substrate and said treatment formulation by rotating said treatment chamber.

6. The method as claimed in claim 1 further comprising, before or after said agitating the moistened animal substrate with a treatment formulation and a solid particulate material, subjecting said animal substrate to at least one further treatment comprising contacting the animal substrate with at least one colourant.

7. The method as claimed in claim 1 wherein the ratio of solid particulate material to animal substrate is from 1000:1 to 1:1000 w/w.

8. The method according to claim 7 wherein the ratio of the solid particulate material to the animal substrate is from about 5:1 to about 1:5 w/w.

9. The method according to claim 7 wherein the ratio of the solid particulate material to the animal substrate is from about 1:2 to about 1:1 w/w.

10. The method according to claim 2 wherein the ratio of water to solid particulate material in the treatment formulation is from 1000:1 to 1:1000 w/w.

11. The method according to claim 10 wherein the ratio of water to solid particulate material in the treatment formulation is from about 1:1 to about 1:100 w/w.

12. The method according to claim 1 wherein the substrate is moistened by wetting so as to achieve a water to animal substrate ratio of between 1000:1 and 1:1000 w/w.

13. The method of claim 12 wherein the animal substrate is moistened by wetting so as to achieve a water to animal substrate ratio of from about 1:100 to about 1:1 w/w.

14. The method of claim 2 wherein the ratio of water to animal substrate in the treatment formulation is from at least 1:40 w/w to about 10:1 w/w.

15. The method of claim 2 wherein the treatment formulation comprises at least 5% w/w water.

16. The method of claim 15 wherein the treatment formulation comprises not more than 99.9 w/w water.

17. The method according to claim 2 wherein the ratio of the solid particulate material to the animal substrate to water is from about 1:1:1 to about 50:50:1 w/w.

18. The method according to claim 1 wherein the ratio of the solid particulate material to the animal substrate to water is from about 1:1:0 to about 50:50:0 w/w.

19. The method according to claim 1 wherein the solid particulate material has an average density of 0.5 to 20 $g/cm^3$.

20. The method according to claim 19 wherein the solid particulate material has an average density of 0.5 to 3.5 $g/cm^3$.

21. The method according to claim 1 wherein the solid particulate material has an average mass of 1 mg to 100 g.

22. The method according to claim 1 wherein the solid particulate material has an average particle diameter of from 1 mm to 15 mm.

23. The method according to claim 1 wherein the solid particulate material has a length of from 1 mm to 15 mm.

24. The method according to claim 1 wherein the solid particulate material comprises a multiplicity of polymeric particles, a multiplicity of non-polymeric particles, or a mixture of a multiplicity of polymeric and non-polymeric particles.

25. The method according to claim 24 wherein the polymeric or non-polymeric particles comprise beads.

26. The method according to claim 24 wherein the polymeric particles have an average volume of from 5 to 275 $mm^3$.

27. The method according to claim 24 wherein the polymeric particles and insert are selected from the group consisting of particles of polyalkenes, polyamides, polyesters, polysiloxanes, polyurethanes and copolymers thereof.

28. The method according to claim 24 wherein the non-polymeric particles are selected from the group consisting of particles of ceramic material refractory material, igneous minerals, sedimentary minerals, metamorphic minerals; composites, metal, glass and wood.

29. The method according to claim 1 wherein the treatment formulation comprises two or more portions and wherein each portion of the treatment formulation may be the same or different.

30. The method according to claim 1 wherein the treatment formulation comprises at least a first portion for cleaning the animal substrate and at least a second portion comprising said at least one treatment agent selected from tanning agents, re-tanning agents and tannery process agents.

31. The method according to claim 1 wherein the method includes a step of exposing the animal substrate to carbon dioxide.

32. The method of claim 1 wherein the particles are re-used 10 or more times.

33. The method of claim 5 comprising recirculating the solid particulate material into the treatment chamber via recirculation means.

34. The method of claim 5 wherein uncoated, washed or cleaned solid particulate material is introduced into the treatment chamber.

35. The method of claim 1 including the step of subjecting the particles to a cleaning procedure after the treatment of the animal substrate.

36. The method according to claim 1 wherein the method consists of a treatment cycle comprising one or more phases or stages.

37. The method according to claim 36 wherein the treatment formulation comprises at least a first portion and a second portion wherein said first portion is added at a different phase or stage in the treatment cycle to the second portion of the treatment formulation.

38. The method of claim 1, wherein the animal substrate is for human use.

39. An animal substrate obtained by the method of claim 1.

40. A method as claimed in claim 1 comprising one or more subsequent processing steps selected from drying, coating, lacquering, polishing, cutting, shaping, forming, embossing, punching, gluing, sewing, stapling and packaging the treated animal substrate or one or more parts thereof.

41. A method as claimed in claim 40 wherein said one or more subsequent processing steps comprise producing a finished leather substrate.

42. A method as claimed in claim 40 wherein said one or more subsequent processing steps comprise producing a finished leather good.

43. A method as claimed in claim 42 wherein said finished leather good is selected from one or more of: articles of apparel and personal accessories, footwear, bags, briefcases and suitcases, saddlery, furniture and upholstered articles, sporting goods and accessories, pet collars and leashes, and vehicle interior coverings.

44. A finished leather good or a component of a finished leather good obtained by a method according to claim 1.

45. A method as claimed in claim 1 wherein the treatment formulation comprises at least one tanning agent.

46. A method as claimed in claim 4 wherein the tanning or retanning agent is a vegetable tanning agent, optionally wherein said vegetable tanning agent comprises tannins which are polyphenols.

47. The method according to claim 1, further comprising a step wherein the animal substrate is agitated with a treatment formulation comprising one or more oils, optionally wherein the treatment formulation comprises oils with at least one sulphur moiety to provide softness and flexibility to the animal substrate.

48. The method according to claim 2, wherein the tanning agents comprises synthetic tanning agents, optionally wherein the synthetic tanning agents are optionally amino resins, polyacrylates, fluoro and/or silicone polymers and formaldehyde condensation polymers based on phenol, urea, melamine, naphthalene, sulphone, cresol, bisphenol A, naphthol and/or biphenyl ether.

49. The method according to claim 1, wherein the treatment formulation includes one or more waterproofing agent(s), optionally, wherein the waterproofing agents are hydrophobic silicones.

50. The method as claimed in claim 35, wherein said particles are cleaned intermittently.

51. The method of claim 50, wherein the particles are cleaned after every 10, after every 5, after every 3, after every 2 or after every 1 agitation step(s).

52. The method as claimed in claim 50, wherein the particle cleaning step comprises washing the particles with a cleaning formulation which is water, an organic solvent or a mixture thereof.

53. The method of claim 52, wherein the cleaning formulation comprises one or more cleaning agents to aid the removal of any contaminants.

54. The method of claim 53, wherein said cleaning agents are selected from the group consisting of surfactants, detergents, dye transfer agents, biocides, fungicides, builders and metal chelating agents.

55. The method as claimed in claim 50, wherein the particles are agitated during cleaning.

* * * * *